US009999283B2

(12) United States Patent
Jose

(10) Patent No.: US 9,999,283 B2
(45) Date of Patent: Jun. 19, 2018

(54) COLLAPSIBLE LUGGAGE AND A METHOD FOR ITS USE

(71) Applicant: Boban Jose, San Ramon, CA (US)

(72) Inventor: Boban Jose, San Ramon, CA (US)

( * ) Notice: Subject to any disclaimer, the term of this patent is extended or adjusted under 35 U.S.C. 154(b) by 205 days.

(21) Appl. No.: 14/986,232

(22) Filed: Dec. 31, 2015

(65) Prior Publication Data

US 2017/0188673 A1 Jul. 6, 2017

(51) Int. Cl.

| | |
|---|---|
| ***A45C 5/02*** | (2006.01) |
| ***A45C 7/00*** | (2006.01) |
| ***A45C 5/03*** | (2006.01) |
| ***A45C 5/14*** | (2006.01) |
| ***A45C 13/36*** | (2006.01) |
| ***A45C 13/26*** | (2006.01) |

(52) U.S. Cl.

CPC ..... *A45C 7/0036* (2013.01); *A45C 5/03* (2013.01); *A45C 5/14* (2013.01); *A45C 13/262* (2013.01); *A45C 13/36* (2013.01)

(58) Field of Classification Search

CPC ..... A45C 5/14; A45C 13/262; A45C 5/146; A45C 13/385; A45C 3/004

USPC ..... 190/18 A, 18 R, 107, 114, 21, 127, 103

See application file for complete search history.

(56) References Cited

U.S. PATENT DOCUMENTS

| | | | |
|---|---|---|---|
| 853,566 | A | 5/1907 | Sparks |
| 2,416,783 | A | 3/1947 | Vallieres |
| 2,517,178 | A | 8/1950 | Cheatham |
| 2,538,616 | A | 1/1951 | Cross |
| 2,718,943 | A | 9/1955 | Braverman |
| 3,606,372 | A | 9/1971 | Browning |
| 3,814,220 | A | 6/1974 | Brody |
| 4,146,045 | A | 3/1979 | Grant |
| 4,160,496 | A | 7/1979 | Knight |

(Continued)

FOREIGN PATENT DOCUMENTS

| | | | |
|---|---|---|---|
| DE | 202009010549 | U1 | 10/2009 |
| WO | 0152687 | A | 7/2001 |

(Continued)

OTHER PUBLICATIONS

Search Report and Written Opinion dated May 13, 2016 from International Serial No. PCT/US2016/017464 filed Feb. 11, 2016.

(Continued)

*Primary Examiner* — Fenn C Mathew
*Assistant Examiner* — Cynthia Collado
(74) *Attorney, Agent, or Firm* — Law Office of Ilya Libenzon

(57) ABSTRACT

A collapsible luggage includes a lower part forming an open-topped box having a substantially rigid bottom and a substantially rigid sidewall substantially perpendicular to the bottom. The collapsible suitcase includes a collapsible upper part having a plurality of panels, each panel of the plurality of panels having a top edge, and a bottom edge pivotally joined to the upper edge of the sidewall so that each panel may be rotated between a deployed position substantially parallel to the sidewall and a collapsed position with the panel folded into the interior of the lower part, at least one substantially rigid corner brace attached to one of the panels, and at least one fastener that attaches each corner brace to the interior surface of a second panel, adjacent to the first panel, of the plurality of panels.

20 Claims, 18 Drawing Sheets

(56) References Cited

U.S. PATENT DOCUMENTS

| | | | | |
|---|---|---|---|---|
| 4,221,402 | A | 9/1980 | Kazmark | |
| 4,538,709 | A | 9/1985 | Williams et al. | |
| 4,588,056 | A | 5/1986 | Bembaum | |
| 4,795,186 | A | 1/1989 | Tyus | |
| 5,265,307 | A | 11/1993 | Hull et al. | |
| 5,375,685 | A | 12/1994 | Plath | |
| 5,407,405 | A | 4/1995 | Oren | |
| 5,433,303 | A | 7/1995 | Chen | |
| 5,464,080 | A | 11/1995 | Liang | |
| 5,564,538 | A | 10/1996 | Sadow | |
| 5,699,886 | A | 12/1997 | Latshaw | |
| 5,806,143 | A | 9/1998 | Tsai | |
| 5,904,230 | A | 5/1999 | Peterson | |
| 5,924,533 | A | 7/1999 | Cnockaert et al. | |
| 6,024,264 | A | 2/2000 | Java | |
| 6,105,508 | A | 8/2000 | Ryburg | |
| 6,213,265 | B1 | 4/2001 | Wang | |
| 6,279,706 | B1 | 8/2001 | Mao | |
| 6,357,080 | B1 | 3/2002 | Tsai | |
| 6,470,533 | B1 | 10/2002 | Comstock | |
| 6,540,134 | B1 | 4/2003 | Rasche | |
| 6,543,796 | B1 | 4/2003 | Johnson et al. | |
| 6,564,426 | B1 | 5/2003 | Wang | |
| 6,776,300 | B2 | 8/2004 | Walsh et al. | |
| 6,898,823 | B2 | 5/2005 | Tsai | |
| 6,978,514 | B2 | 12/2005 | Kuo et al. | |
| 7,328,796 | B2 | 2/2008 | Brunson et al. | |
| 7,445,216 | B1 | 11/2008 | Chou | |
| 7,451,861 | B2 | 11/2008 | Bhavnani | |
| 7,617,956 | B1 | 11/2009 | Sabbah | |
| 7,832,532 | B2 | 11/2010 | Nykoluk et al. | |
| 7,845,508 | B2 | 12/2010 | Rothschild et al. | |
| 7,987,955 | B2 | 8/2011 | Puchalski | |
| 8,317,558 | B2 | 11/2012 | Bucknell et al. | |
| 8,613,349 | B1 | 12/2013 | Halko et al. | |
| 8,662,267 | B1 | 3/2014 | Hart et al. | |
| 8,869,960 | B2 | 10/2014 | Mangano | |
| 9,277,796 | B1 | 3/2016 | Elam | |
| 9,560,902 | B2 * | 2/2017 | Hogan | A45C 7/0022 |
| 9,801,440 | B2 * | 10/2017 | Hogan | A45C 5/14 |
| 2002/0056736 | A1 | 5/2002 | Conte | |
| 2002/0084159 | A1 | 7/2002 | Hamlin | |
| 2002/0096410 | A1 | 7/2002 | Nykoluk | |
| 2003/0102195 | A1 | 6/2003 | Mittleman et al. | |
| 2003/0132079 | A1 | 7/2003 | Bellini | |
| 2004/0108345 | A1 | 6/2004 | Oh | |
| 2004/0181906 | A1 | 9/2004 | Kuo et al. | |
| 2004/0238304 | A1 | 12/2004 | Fisher | |
| 2005/0011043 | A1 | 1/2005 | Comstock | |
| 2005/0015932 | A1 | 1/2005 | Tsai | |
| 2005/0016809 | A1 | 1/2005 | Wu | |
| 2005/0082131 | A1 | 4/2005 | Fenton et al. | |
| 2005/0098402 | A1 | 5/2005 | Cohen | |
| 2005/0183914 | A1 | 8/2005 | Lin | |
| 2006/0037825 | A1 | 2/2006 | Dayton et al. | |
| 2006/0076203 | A1 | 4/2006 | Miller | |
| 2006/0118376 | A1 | 6/2006 | Godshaw et al. | |
| 2006/0272126 | A1 | 12/2006 | Burgess et al. | |
| 2006/0272913 | A1 * | 12/2006 | Chen | A45C 7/0036 190/127 |
| 2007/0007801 | A1 | 1/2007 | Bishop | |
| 2007/0012593 | A1 | 1/2007 | Kitchens et al. | |
| 2007/0089952 | A1 | 4/2007 | Herbst et al. | |
| 2007/0151820 | A1 * | 7/2007 | Lin | A45C 7/0022 190/103 |
| 2007/0164064 | A1 | 7/2007 | Nathan | |
| 2007/0267262 | A1 * | 11/2007 | Sederoff | A45C 5/14 190/103 |
| 2008/0078790 | A1 | 4/2008 | Bolling | |
| 2010/0051633 | A1 | 3/2010 | Porte et al. | |
| 2010/0089778 | A1 | 4/2010 | Park | |
| 2010/0282555 | A1 * | 11/2010 | Tseng | A45C 7/0036 190/103 |
| 2010/0282556 | A1 | 11/2010 | Tseng et al. | |
| 2010/0300825 | A1 * | 12/2010 | Nordstrom | A45C 7/0036 190/107 |
| 2010/0313383 | A1 | 12/2010 | Lai | |
| 2011/0132708 | A1 | 6/2011 | DeLine et al. | |
| 2011/0209960 | A1 | 9/2011 | MacLean et al. | |
| 2012/0217109 | A1 | 8/2012 | King et al. | |
| 2012/0273314 | A1 | 11/2012 | Raymond et al. | |
| 2012/0325607 | A1 | 12/2012 | Webster et al. | |
| 2013/0032443 | A1 | 2/2013 | Soedomo | |
| 2013/0075213 | A1 | 3/2013 | Chen et al. | |
| 2013/0075214 | A1 | 3/2013 | Chen et al. | |
| 2013/0098410 | A1 | 4/2013 | Prasannakumar et al. | |
| 2013/0153351 | A1 | 6/2013 | House | |
| 2013/0175130 | A1 | 7/2013 | Liang | |
| 2013/0233362 | A1 | 9/2013 | Miller-Klerer | |
| 2013/0264160 | A1 | 10/2013 | Mediamolle | |
| 2014/0048369 | A1 * | 2/2014 | Zhu | A45C 7/0036 190/21 |
| 2014/0151172 | A1 | 6/2014 | Diaz | |
| 2014/0238799 | A1 | 8/2014 | Sharma | |
| 2014/0299428 | A1 | 10/2014 | Gadbois | |
| 2015/0047939 | A1 | 2/2015 | Chang | |
| 2015/0272291 | A1 | 10/2015 | Sener et al. | |
| 2015/0305295 | A1 * | 10/2015 | Frankel | A47B 43/00 119/514 |
| 2015/0348347 | A1 | 12/2015 | Diz et al. | |
| 2016/0113388 | A1 | 4/2016 | Distefano | |

FOREIGN PATENT DOCUMENTS

| | | | |
|---|---|---|---|
| WO | 2009027992 | A2 | 3/2009 |
| WO | 2009039154 | A1 | 3/2009 |
| WO | 2013080236 | A1 | 6/2013 |

OTHER PUBLICATIONS

Search Report and Written Opinion dated May 13, 2016 from International Serial No. PCT/US2016/017470 filed Feb. 11, 2016.
Search Report and Written Opinion dated May 13, 2016 from International Serial No. PCT/US2016/017475 filed Feb. 11, 2016.
Search Report and Written Opinion dated May 19, 2016 from International Serial No. PCT/US2016/017447 filed Feb. 11, 2016.
Search Report and Written Opinion dated Aug. 31, 2016 from International Serial No. PCT/US2016/036485 filed Jun. 8, 2016.
Search Report and Written Opinion dated Aug. 31, 2016 from International Serial No. PCT/US2016/036494 filed Jun. 8, 2016.

* cited by examiner

COLLAPSIBLE LUGGAGE AND A METHOD FOR ITS USE

TECHNICAL FIELD

The device and methods disclosed herein relate generally to luggage, and particularly to folding luggage.

BACKGROUND ART

Suitcases and luggage are a traveler's constant companions. Luggage can be used to transport items such as clothing, papers, electronics, gifts and memorabilia in bulk, enabling travelers to keep track of their effects more easily. Luggage generally presents the traveler with trade-offs: hard suitcases can protect fragile items, but tend to take up large amounts of space, whether empty or full. As travelers frequently do not carry the same quantity of objects on all legs of their journeys, using hard cases can frequently mean spending time and effort carrying large, empty receptacles from one place to another. Soft luggage is more compact and extensible, but provides less protection for valuable or fragile goods. Some solutions to this dilemma in the past have included gussets, which allow limited expansion of hard cases, with small corresponding loss of security, or collapsible suitcases that combine hard and soft components in an attempt to compromise between the disadvantages of the two forms. This only partially solves the issues presented by traditional luggage design.

Therefore, there remains a need for a fully collapsible hard luggage item that is durable and convenient to use.

SUMMARY OF THE EMBODIMENTS

In one aspect, a collapsible luggage item includes a lower part forming an open-topped box having a substantially rigid bottom, the bottom having an interior surface, and a substantially rigid sidewall substantially perpendicular to the bottom, the sidewall having an exterior surface, an interior surface, a lower edge attached to the bottom, and an upper edge defining the perimeter of an opening of the lower part, the interior surface of the bottom and the interior surface of the sidewall defining an interior of the lower part. The luggage item includes a collapsible upper part having a plurality of panels, each panel of the plurality of panels having an interior surface, an exterior surface, a top edge, and a bottom edge pivotally joined to the upper edge of the sidewall so that each panel may be rotated between a deployed position substantially parallel to the sidewall with the top edge of the panel above the bottom edge of the panel and a collapsed position with the panel folded into the interior of the lower part, the top edges of the plurality of panels combining to define an opening of the luggage item when each of the plurality of panels is in the deployed position. The upper part includes at least one substantially rigid corner brace attached to a first panel of the plurality of panels and at least one fastener that attaches each corner brace of the at least one corner brace to the interior surface of a second panel, adjacent to the first panel, of the plurality of panels.

In a related embodiment, the plurality of panels includes four panels. In an additional embodiment, the at least one corner brace includes four corner braces. In another embodiment, two of the corner braces are attached to the first panel and two more of the corner braces are attached to a third panel, of the plurality of panels, which is not adjacent to the first panel. In another embodiment, one corner brace is attached to each of the four panels. In another related embodiment, the at least one corner brace is pivotally connected to the interior surface of the first panel, the at least one corner brace movable between an extended position sufficiently close to the interior surface of the adjacent panel to fasten the fastener when the plurality of panels are in the deployed position and a folded position too distant from the interior surface of the adjacent panel to fasten the fastener when the plurality of panels are in the deployed position. In yet another embodiment, a horizontal cross-section of the at least one corner brace is substantially arcuate. In another embodiment still, the at least one corner brace includes at least one reinforcing rib.

In an additional embodiment, the at least one fastener includes a slide-release buckle. Another embodiment includes a flexible exterior cover that contacts the exterior surfaces of the plurality of panels when in deployed position. In a related embodiment, the exterior cover is attached to the exterior surfaces of the plurality of panels. In a further embodiment, the exterior cover has a lower edge attached to the upper edge of the sidewall. In a further embodiment still, the exterior cover has a lower edge attached to the bottom surface. In still another embodiment, the exterior cover covers substantially all of the bottom and the exterior surface of the sidewall. In yet another embodiment, the plurality of panels is pivotally attached to lower portion by the exterior cover. In an additional embodiment, the exterior cover includes at least one pocket accessible from an exterior surface of the exterior cover. Yet another embodiment includes a lid moveable to cover the opening of the item of luggage. An additional embodiment includes at least one wheel attached to the luggage item, so that the at least one wheel contacts a walking surface when a user drags the luggage item across the walking surface. Another embodiment includes an extension handle that a user may grip to drag the luggage item across a walking surface.

In another aspect, a method for collapsing a collapsible luggage item includes providing a luggage item as described above. The method includes unfastening the at least one fastener. The method includes rotating the plurality of panels toward the collapsed position.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method is shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood that the invention is not limited to the precise arrangements and instrumentalities shown.

DETAILED DESCRIPTION OF SPECIFIC EMBODIMENTS

Figure 1A:
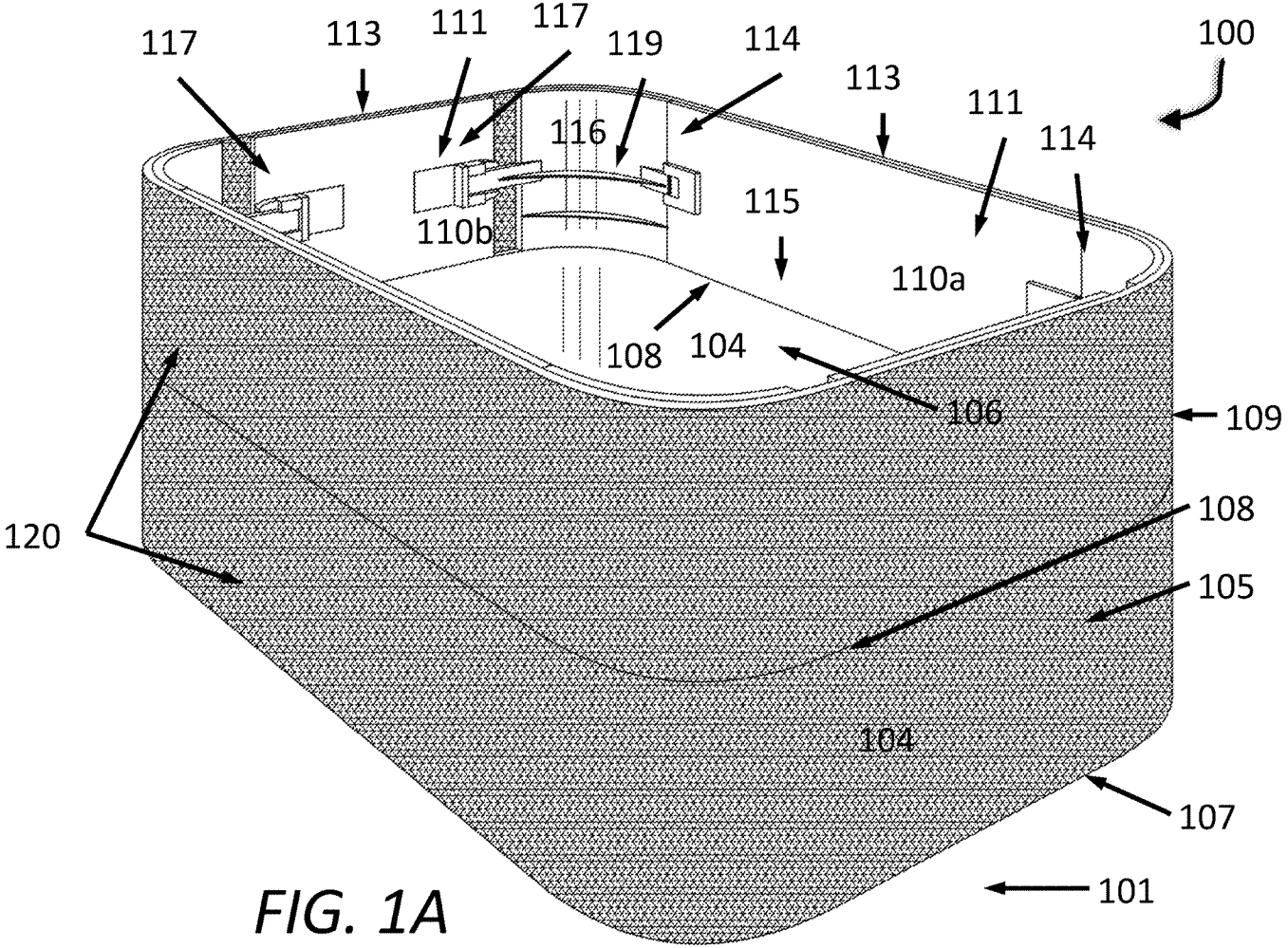
FIG. 1A is a schematic diagram illustrating one embodiment of a collapsible luggage item.
Figure 1B:
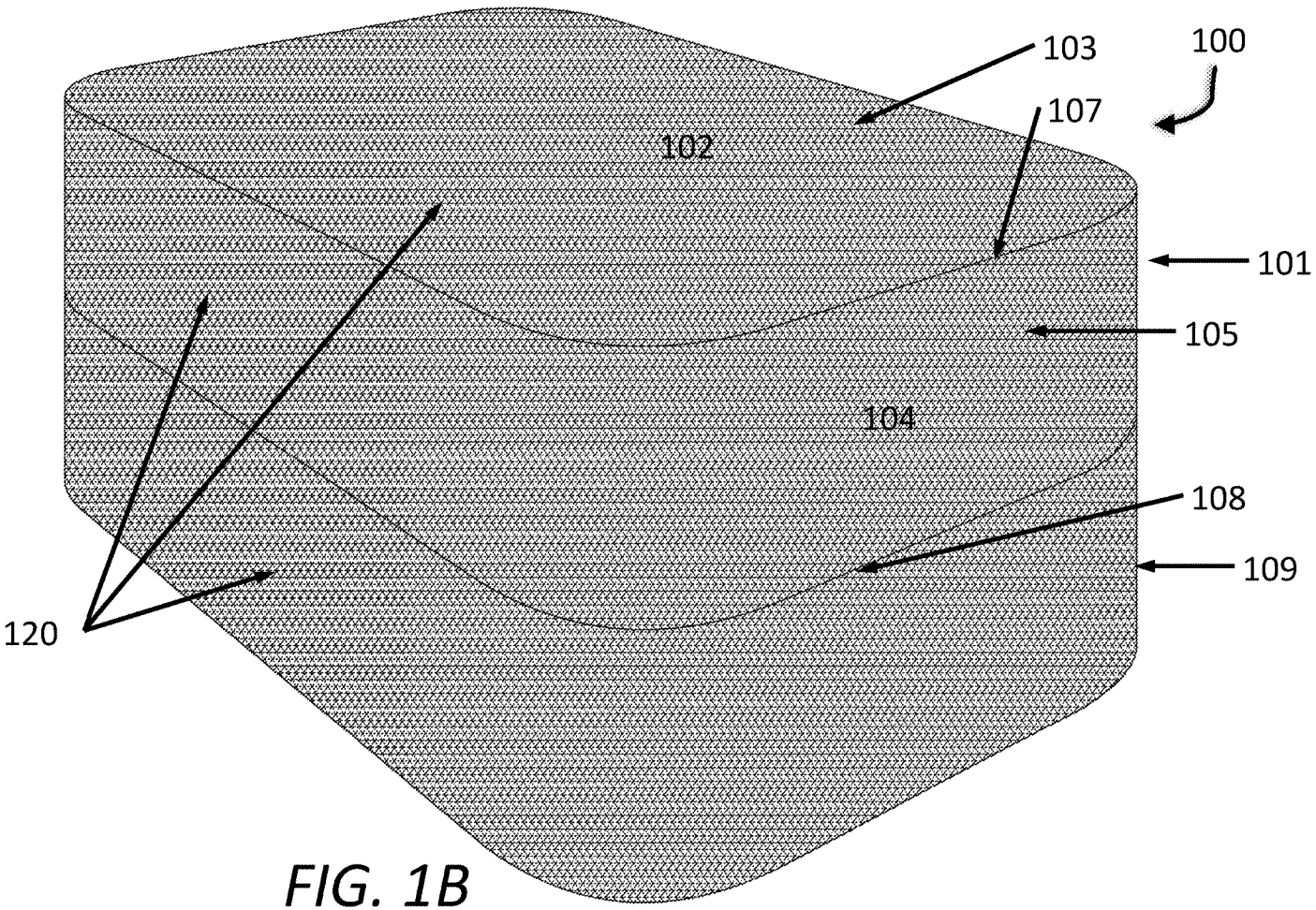
FIG. 1B is a schematic diagram showing the underside of an embodiment of the collapsible luggage item.
Figure 1C:
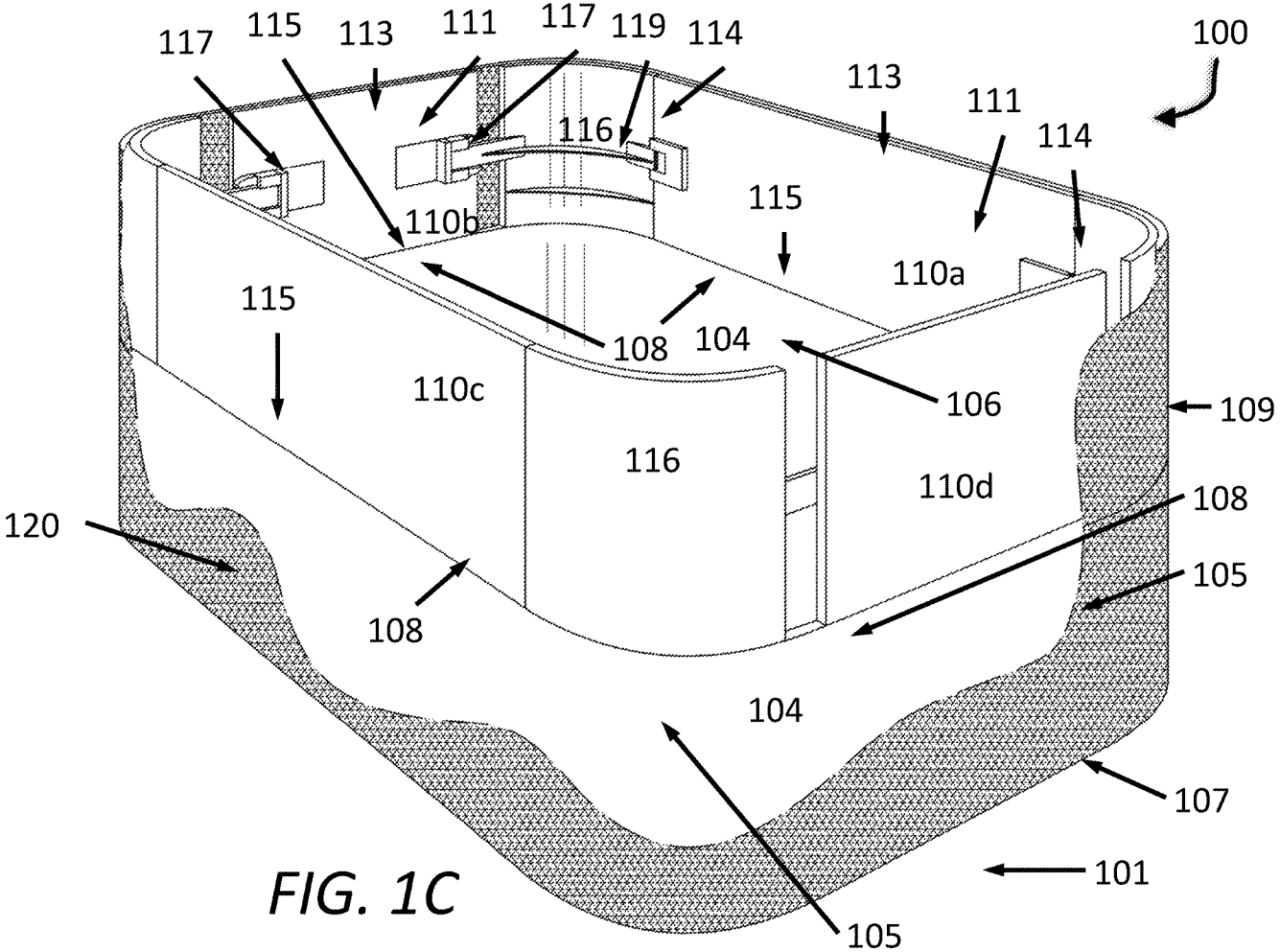
FIG. 1C is a schematic diagram showing a portion of the exterior cover of an embodiment cut away.

Embodiments of the disclosed suitcase provide travelers with luggage item that easily collapses to half of its volume. In some embodiments, the corner braces and folding panels described below readily snap into deployed position when the user wishes to use the luggage item to transport possessions. In some embodiments, the fasteners detach in a straightforward fashion to allow the user to collapse the luggage item.

FIGS. 1A-1D depict some embodiments of a collapsible luggage item 100. The luggage item 100 includes a lower part 101 forming an open-topped box. The lower part 101 includes a substantially rigid bottom 102, the bottom having an exterior surface 103 and an interior surface. The lower part 101 also includes a substantially rigid sidewall 104 substantially perpendicular to the bottom 102, the sidewall 104 having an exterior surface 105, an interior surface 106, a lower edge 107 attached to the bottom, and an upper edge 108 defining the perimeter of an opening of the lower part 101. The interior surface of the bottom 102 and the interior surface 106 of the sidewall 104 define an interior of the bottom part 101.

Figure 1D:
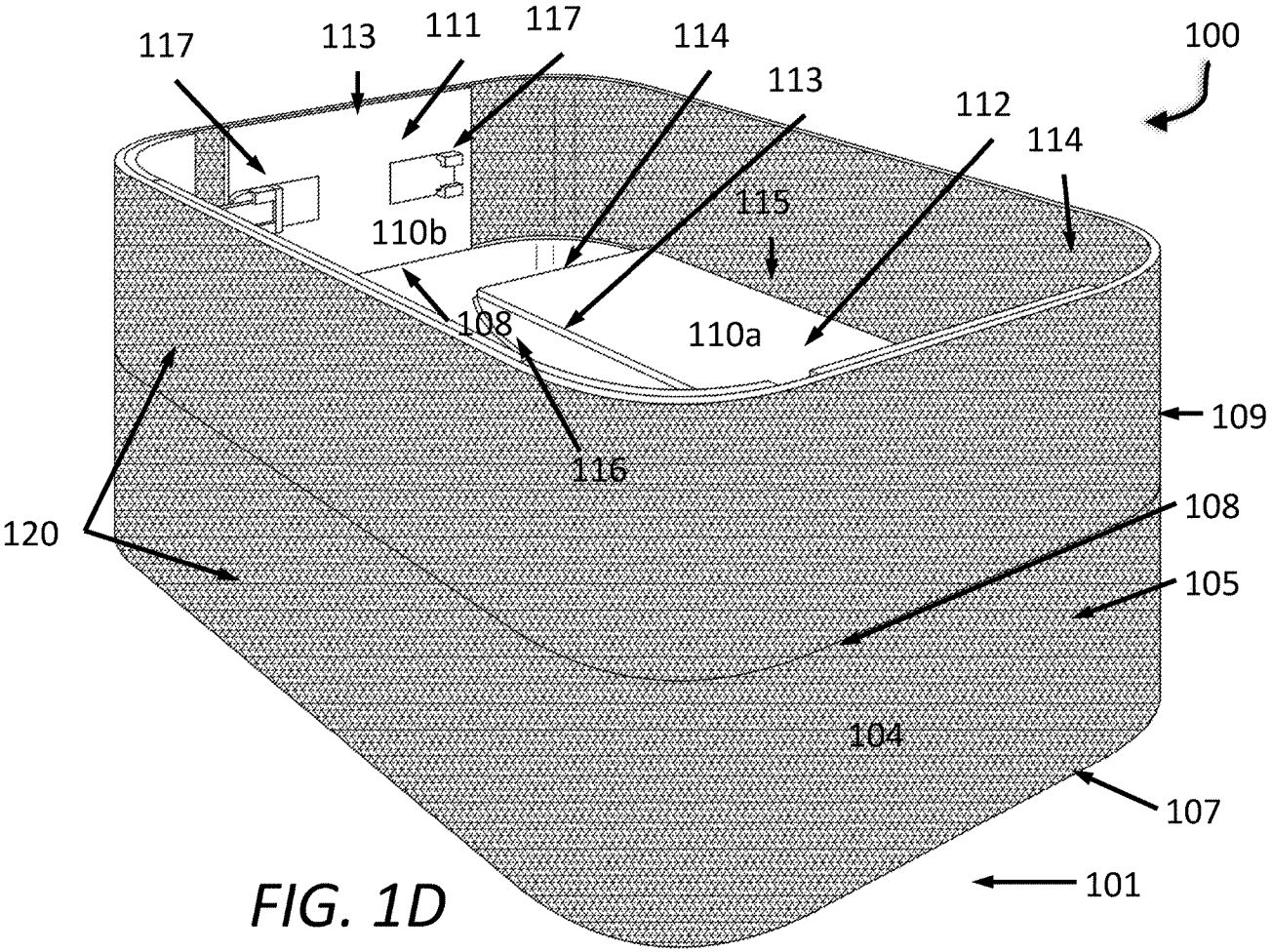
FIG. 1D is a schematic diagram showing an embodiment of the collapsible luggage item with one panel in collapsed position.

The collapsible luggage item 100 includes a collapsible upper part 109. The collapsible upper part 109 includes a plurality of panels 110*a-d*. Each panel of the plurality of panels 110*a-d* may have an interior surface 111, an exterior surface 112, and two side edges 114. Each panel of the plurality of panels has a top edge 113 and a bottom edge 115 pivotally joined to the upper edge of the sidewall. The pivotal connection between the bottom edge 115 of each panel and the upper edge 108 of the sidewall is such that each panel 110*a-d* may be rotated between a deployed position substantially parallel to the sidewall 104 with the top edge 113 of the panel 110*a-d* above the bottom edge 111 of the panel and a collapsed position with the panel folded into the interior of the bottom portion 101. FIG. 1A shows an embodiment of the luggage item 100 with all of the plurality of panels 110*a-d* in the deployed position. The top edges of the plurality of panels may combine to define an opening of the luggage item 100 when each of the plurality of panels 110*a-d* is in the deployed position. FIG. 1D depicts one embodiment of the luggage item 100 in which a single panel 110*a* is in the collapsed position.

The collapsible upper part 109 includes at least one substantially rigid corner brace 116. The at least one substantially rigid corner brace 116 is attached to a first panel 110*a* of the plurality of panels 110*a-d*. The luggage item 100 includes at least one fastener 117 that attaches each corner brace 116 of the at least one corner brace 116 to the interior surface of a second panel 110*b*, adjacent to the first panel 110*a*, of the plurality of panels 110*a-d*.

The bottom 102 of the lower part 101 may be constructed of any material or combination of materials useable for the bottom of a luggage item. The bottom may be constructed in part of rigid materials. In some embodiments, the bottom 102 is substantially rigid if the bottom 102 exhibits only small amounts of displacement relative to the size of the bottom 102 when forces typical for the operation of a luggage item 100 act against the interior or exterior surface of the bottom 102. For instance, if the luggage item 100 in its deployed form is set upside-down, and a person leans on the middle of the bottom 102 for support, the person may feel the bottom 102 flex only slightly; in some embodiments, the person may be incapable of detecting any displacement of the bottom 102 at all. The rigid materials may include metal, wood or wood products such as plywood. The rigid materials may include natural or artificial polymers such as substantially rigid plastic, including without limitation hard plastic, such as thermosetting plastics, hard thermoplastics such as polyvinyl chloride (PVC), high-density polyethylene (HDPE), polytetraflouroethylene, or hard polypropylene. The rigid materials may include resins, crystalline materials, composite materials such as fiberglass, or any other substantially rigid material suitable for use in an item of luggage. The bottom 102 may also include flexible materials, which may be any material suitable for use on the exterior covering as described below; for instance, flexible materials may be layered with rigid materials. The bottom 102 may include one or more compartments; for instance, the bottom 102 may include a compartment for a retractable extension handle, as described below in reference to FIG. 5, as described in further detail below. The bottom 102 may have any shape conducive for use as the bottom of a luggage item. A horizontal cross-section of the bottom 102 may have a perimeter that forms any regular or irregular polygonal shape, any curved shape such as a circle or oval, or any combination of curved and straight linear elements. For instance, the perimeter may be substantially rectangular in form. The substantially rectangular perimeter may have filleted corners, such as rounded corners where two edges of the substantially rectangular perimeter are connected by a circular or elliptical arc, or similar curve. The bottom 102 may have an exterior surface, on which the luggage item 100 may rest when set on a flat surface with the upper part 109 on top of the lower part 101; the exterior surface of the bottom 102 and the exterior surface 105 of the sidewall 104 may together define the exterior of the lower part 101.

The sidewall 104 may be formed from any materials or combination of materials suitable for the construction of the bottom 102. The sidewall may have any horizontal cross-sectional form suitable for the horizontal cross-sectional perimeter of the bottom 102. The cross-sectional form of the sidewall 104 may match the form of the perimeter of the cross-section of the bottom 102; for instance, where the bottom 102 is substantially rectangular, the sidewall 104 and bottom 102 may combine to form a substantially rectangular, open-topped box. As another example, where the bottom 102 perimeter forms a rectangle with rounded corners, the bottom 102 and sidewall 104 together may form a rectangular, open-topped box with rounded vertical edges. The lower edge 107 of the sidewall 104 is attached to the bottom 102; any manner of attachment may be used. In some embodiments, the lower edge 107 is fastened to the bottom 102 by a plurality of fasteners such as screws, nails, rivets, or staples. The lower edge 107 may be sewn to the bottom 102. The lower edge 107 may be adhered to the bottom 102. The lower edge 107 may be fused to the bottom 102; for instance, the lower edge 107 may be attached to the bottom 102 by a heat-sealing process. In other embodiments, the sidewall 104 and bottom 102 form a monolithic whole; for instance, the sidewall 104 and bottom 102 may be created together in a single molding, machining, or rapid prototyping process. Likewise, a single monolithic piece may combine a part of the sidewall 104 with a part of the bottom 102; the single monolithic piece may be joined to any additional pieces of the sidewall 104 or bottom 102 by any means described above.

Each collapsible upper panel 110*a-d* may be constructed from any material or combination of materials suitable for constructing the bottom 102. As a non-limiting example, each panel 110*a-d* may be constructed of rigid material. Each panel 110*a-d* may be constructed of rigid material partially or fully covered by flexible material such as cloth or padding.

The number of panels 110*a-d* may vary depending on the embodiments. In some embodiments, number of panels 110*a-d* match a number of sides described by a lower part 101 having a substantially polygonal horizontal cross-section. The upper part 109 and lower part 101 may have complimentary shapes; for instance, where the lower part 101 forms a substantially rectangular box the upper part 109 may combine with the lower part 101 to form a larger substantially rectangular box. Where the lower part 101 has filleted corners, such as rounded corners, the upper part 109 may have similarly filleted corners, such as rounded corners. As a non-limiting example, where the upper part 109 and lower part 101 combine to form a substantially rectangular box, there may be four panels 110 *a-d*. Each panel 110*a-d* may have an adjacent panel: a second panel 110*b* is adjacent to a first panel 110*a* if, when the panels are in the deployed position, traversing the perimeter of the opening of the bottom portion away from a side edge of the first panel in at least one direction, the next side edge encountered will be a side edge of the second panel. Where the luggage item 100 has a substantially polygonal cross-section, for instance, two panels that are adjacent to one another may be located on two sides of the substantially polygonal horizontal cross-section of the luggage item 100 that share a vertex (albeit the vertex may be filleted, as noted above). There may be space between the side edges of adjacent panels, such that when two adjacent panels are in the deployed position, the side edges of the two adjacent panels are not in contact. For instance, where the luggage item 100 has a substantially polygonal cross-section, the panels 110*a-d* may not meet at the vertices of the polygon; the vertices, or filleted vertices, may be formed by the corner braces 116 as describe below.

Figure 2A:
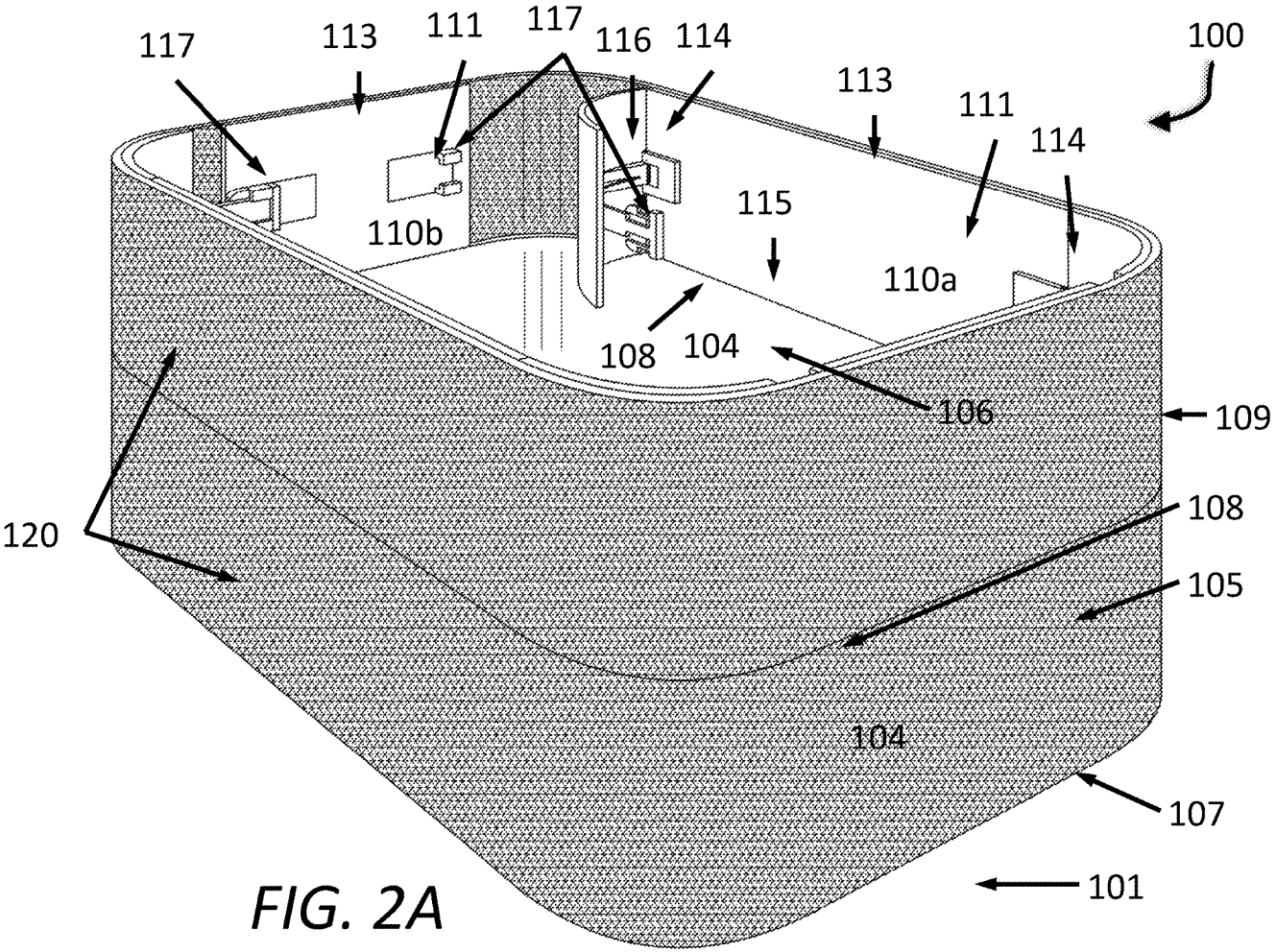
FIG. 2A is a schematic diagram showing an embodiment of the collapsible luggage item with one corner brace unfastened and rotated inward.
Figure 2B:
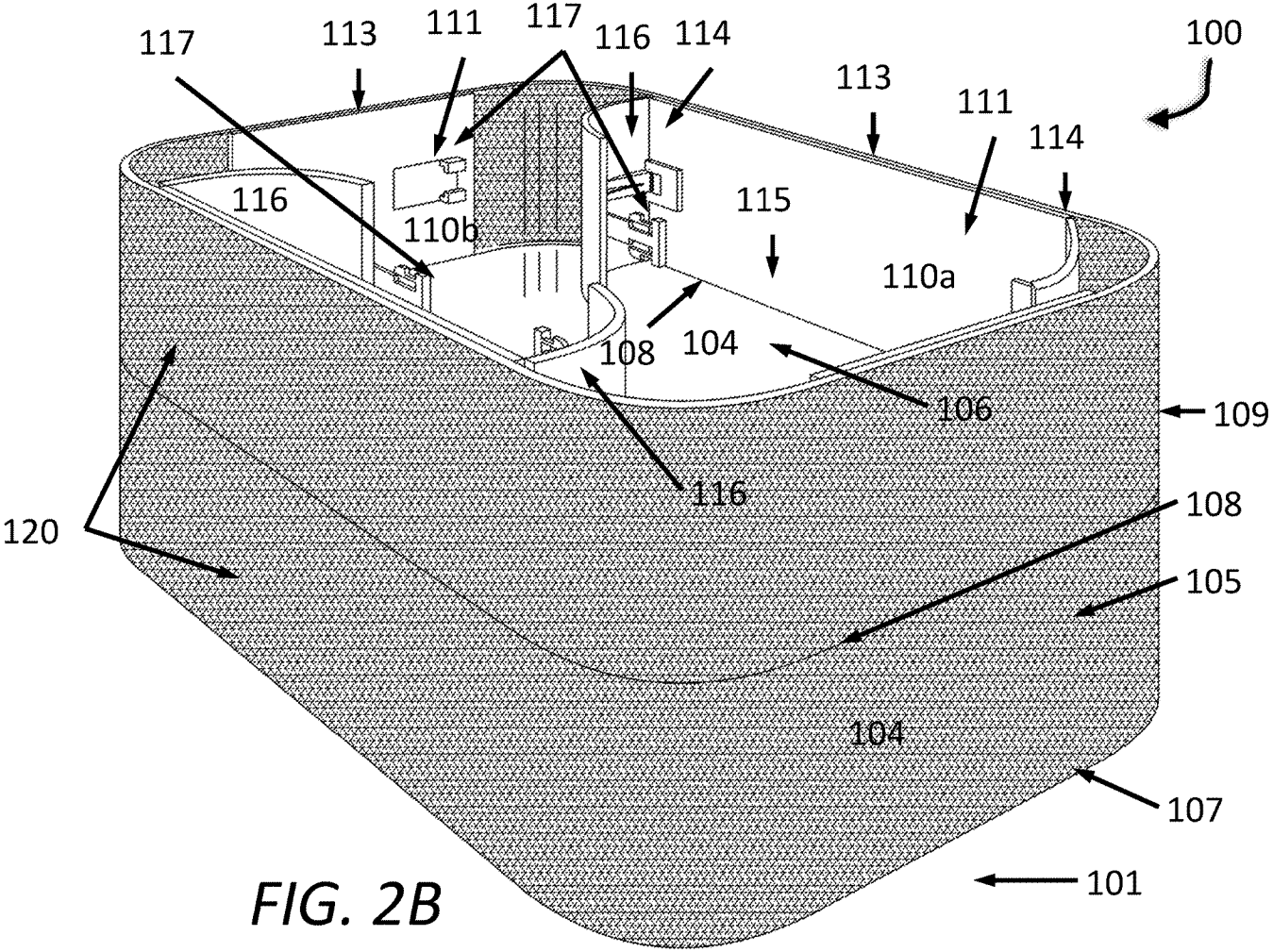
FIG. 2B is a schematic diagram showing an embodiment of the collapsible luggage item with all corner braces unfastened and rotated inward.
Figure 2C:
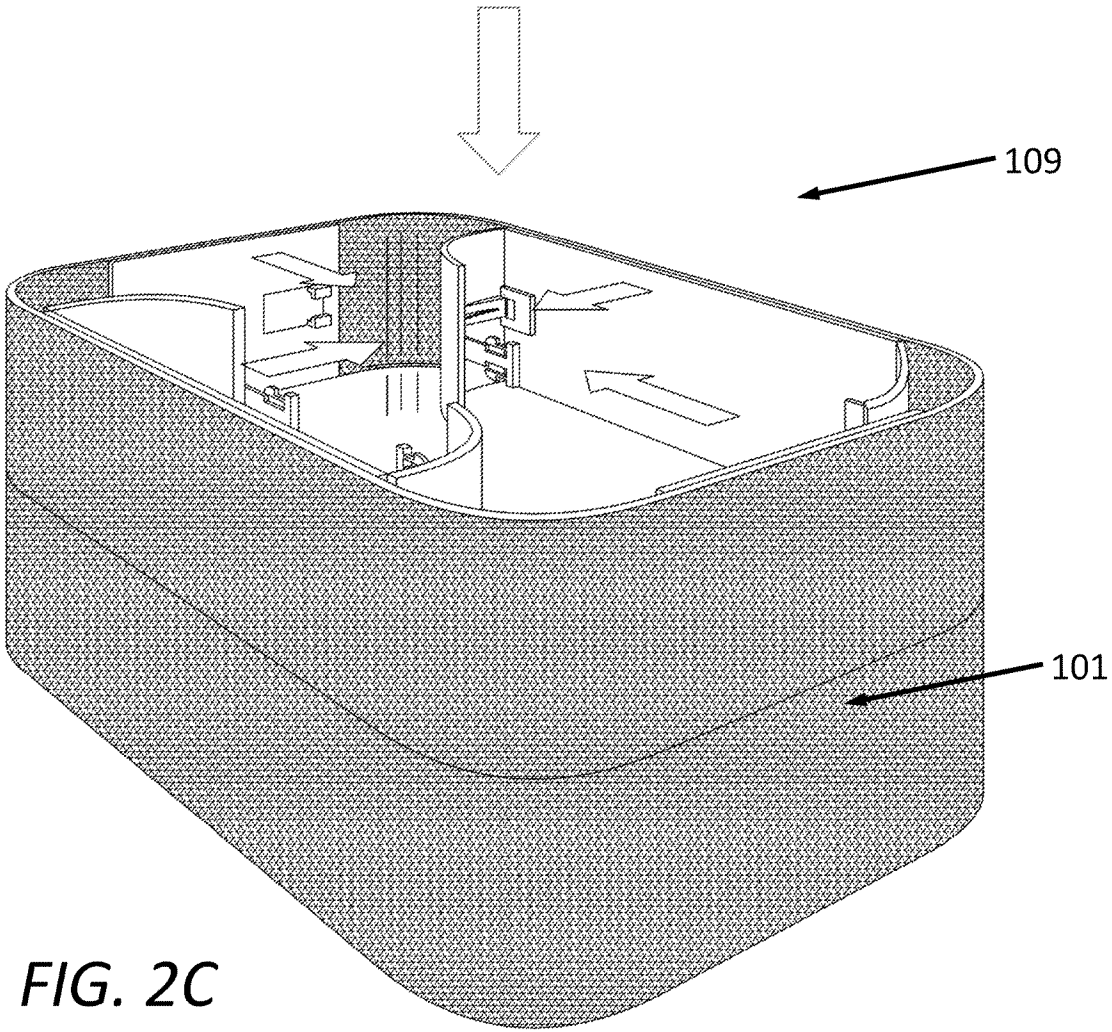
FIG. 2C is a schematic diagram showing how the embodiment depicted in FIG. 2B is collapsed, in one embodiment.
Figure 2D:
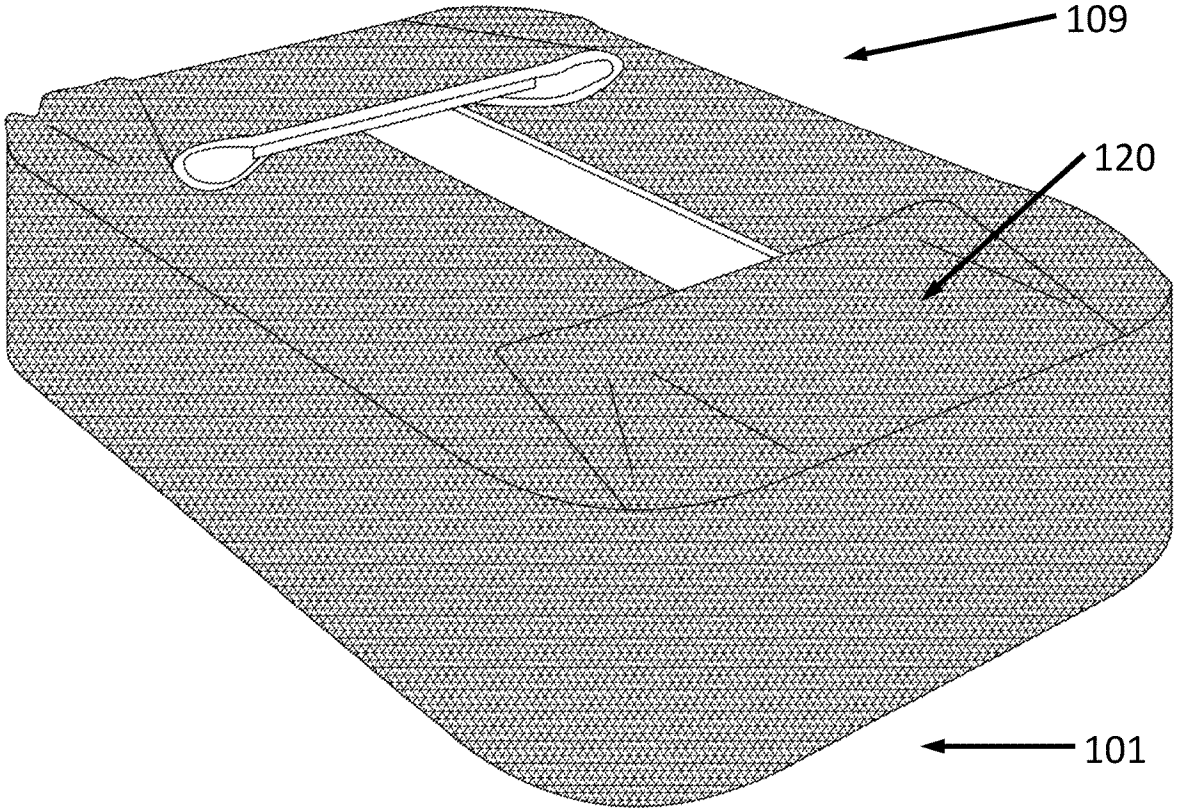
FIG. 2D is a schematic diagram illustrating an embodiment of the luggage item with the upper part collapsed.

The bottom edge of each panel 115 is pivotally joined to the upper edge 108 of the sidewall 104. Each panel 110*a-d* may be rotated between a deployed position, as shown in FIG. 1A, in which the panel 110*a-d* is substantially parallel to the sidewall 104 with the top edge 113 of the panel 110*a-d* above the bottom edge 111 of the panel and a collapsed position with the panel folded into the interior of the bottom portion 101. FIGS. 2A-2D help to illustrate the process of collapsing the panels in one embodiment. FIG. 1D shows an embodiment of the luggage item 100 with a single panel in the collapsed position. FIG. 2D shows an embodiment of the luggage item 100 with the upper portion 109 collapsed by folding all of the panels 110*a-d* toward their collapsed positions. Each panel 110*a-d* may fold inward from the deployed position to the collapsed position, where "inward" signifies, if the panel 110*a-d* in question is attached on a first side of the luggage item, folding the top edge 113 of the panel in question across the luggage item 100 toward a second side of the luggage item 100 opposite the first side. Folding the panel 110*a-d* inward may also tend to cause the top edge 113 of the panel to move downward; the top edge 113 may describe an arc through a plane orthogonal to the axis of rotation of the panel 110*a-d*. The panel 110*a-d* folding inward may pass through the opening of the lower part 101; in other words, where the upper edge 108 of the sidewall 104 describes the perimeter of the opening of the lower part 101, i.e. the opening of an open-topped box, the top edge 113 and substantially all of the rest of the panel 110*a-d* may pass through that opening into the interior of the box. In some embodiments, only the bottom edge 115 and a proximal portion of the panel 110*a-d* that represents a small fraction of the overall size of the panel 110*a-d* may remain outside of the opening; the small fraction may be 10% or less of the height of the panel, where the height of the panel is the vertical distance between the top edge 113 and bottom edge 115 when the panel is in the deployed position.

The bottom edge 115 may be joined to the upper edge 108 by any pivotal connector that permits the panel 110*a-d* to be rotated between the deployed position and the collapsed position. The range of motion of the connector may permit the panel 110*a-d* to rotate beyond the deployed position; for instance, the connector may permit the panel 110*a-d* to rotate outward beyond the sidewall 104, so that the top edge 113 has a greater horizontal distance from the opposite side of the sidewall than the bottom edge 115. Likewise, the connector may permit the panel 110*a-d* to be rotated farther into the interior of the lower part 101; the panel 110*a-d* may be able to rotate until its rotation is arrested by contact with the interior surface of the bottom 102 or the interior surface of the sidewall 106. In practice, of course, the panel 110*a-d* may have its motion arrested by contact with another panel that was previously rotated into the collapsed position 110*a-d*. In some embodiments, when the upper part 109 is fully collapsed, not all of the panels 110*a-d* are in the collapsed position; for instance, one or two of the panels 110*a-d* may be slightly above the opening of the lower part 101 and resting on top of other panels, the exterior covering 120 described below, or both. The connector may be any kind of pivotal connector, including without limitation any kind of hinge or a piece of flexible material that attaches the panel 110*a-d* to the upper edge 108 of the sidewall 104; the flexible material may be a part of the exterior covering 120 described below.

The luggage item 100 includes at least one substantially rigid corner brace 116. The at least one substantially rigid corner brace 116 is attached to a first panel 118 of the plurality of panels 110*a-d*. The at least one substantially rigid corner brace 116 may be constructed of any material or combination of materials suitable for the construction of the bottom 102. The corner braces 116 may serve the function of locking two or more of the panels 110*a-d* in the deployed position when fastened using the fastener, as described below; as a result, the upper part 109 of the luggage item 100 may combine with the lower part 101 to form a usable luggage item 100 with a compartment formed by the combination of the interior of the lower part 101 and the interior surfaces 111 of the plurality of panels 110*a-d*. The number of corner braces 116 may be determined by the number of panels 110*a-d*; for instance, there may be a corner brace 116 between any two adjacent panels. As a non-limiting example, where there are four panels 110*a-d*, there may be four corner braces 116.

Figure 3A:
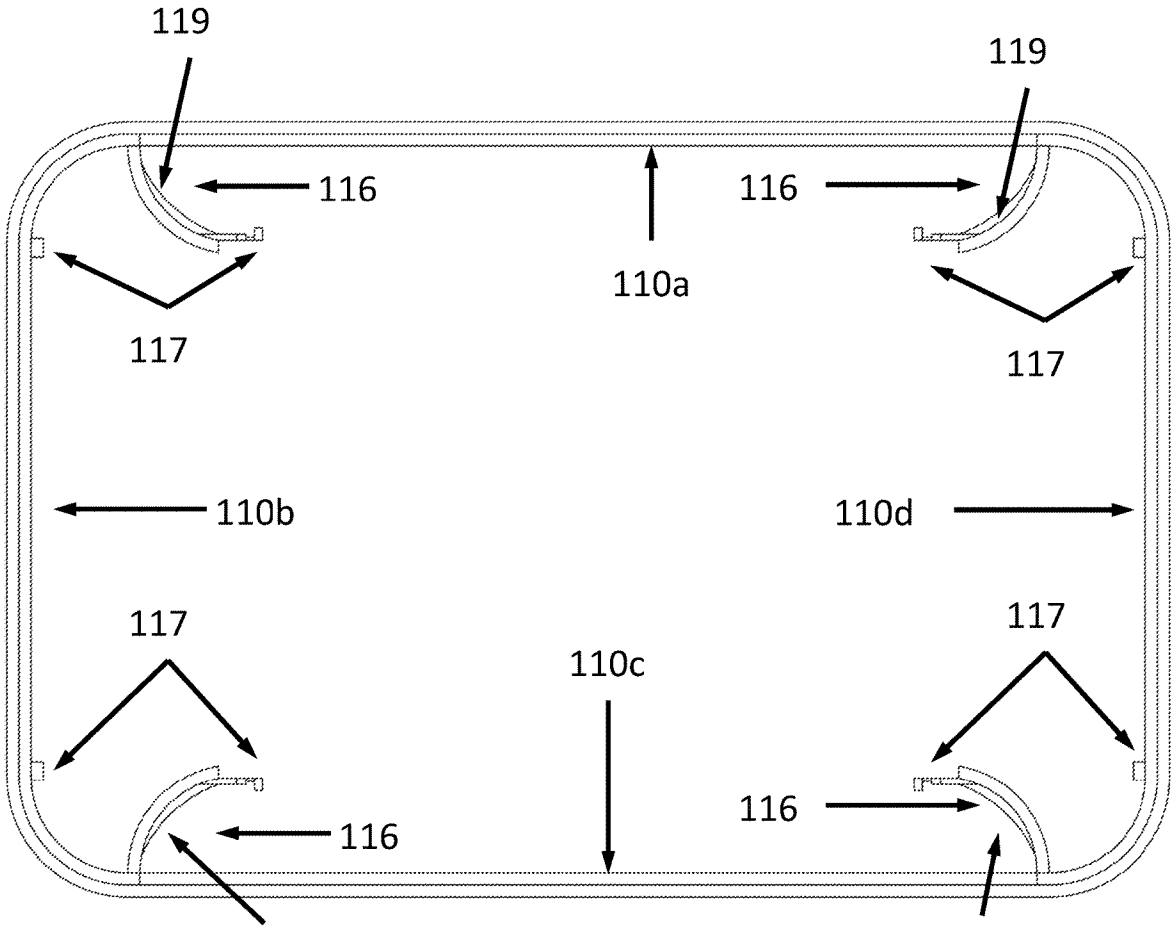
FIG. 3A is a schematic diagram illustrating one embodiment of a possible configuration of panels and corner braces.
Figure 3B:
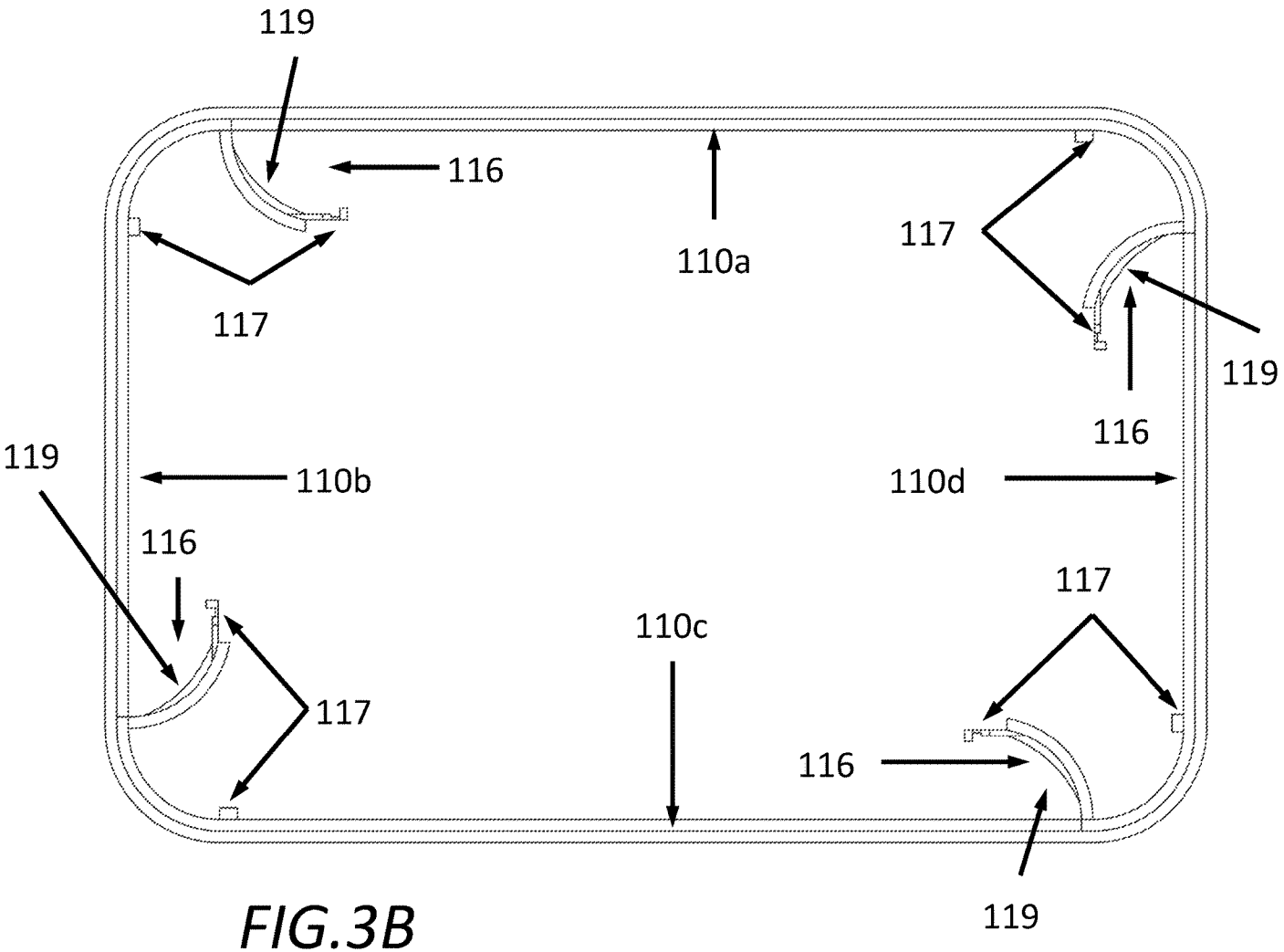
FIG. 3B is a schematic diagram illustrating an embodiment of a possible configuration of panels and corner braces.

The corner braces 116 may be attached in any configuration that permits the corner braces 116 to connect two adjacent panels of the plurality of panels 110*a-d* in some embodiments, as shown in FIGS. 1A-1D and FIG. 3A, two of the corner braces are attached to the first panel 110*a* and two more of the corner braces are attached to a third panel 110*c*, of the plurality of panels, which is not adjacent to the first panel; for instance, where there are four panels 110*a-d*, two panels 110*a*, 110*c* opposite one another may have a corner brace 116 attached near to each of the two side edges 114 of each of the two panels 110*a*, 110*c*, while the other two panels 110*b*, 110*d* may attach to the corner braces 116 using the at least one fastener 117. In other embodiments, as shown in FIG. 3B, one corner brace 116 is attached to each of the four panels 110*a-d*; thus, each panel may have a corner brace 116 attached near one side edge 114, while a fastener 117 may attach another corner brace, attached to an adjacent panel, near to the other side edge 114 of the panel.

The at least one corner brace 116 may be pivotally attached to the first panel 110*a*; for instance, the at least one corner brace 116 may be pivotally connected to the interior surface of the first panel 110*a*, so that the at least one corner brace 116 is movable between an extended position sufficiently close to the interior surface of the adjacent panel to fasten the fastener 117 when the plurality of panels are in the deployed position and a folded position too distant from the interior surface of the adjacent panel to fasten the fastener 117 when the plurality of panels are in the deployed position. FIG. 1A shows an embodiment of the luggage item 100 in which all of the corner braces 116 are in the first position. FIG. 2A shows an embodiment of the luggage item 100 in which one corner brace 116 is unfastened from the adjacent panel and pivoted into the second position. FIG. 2B shows an embodiment of the luggage item 100 in which all of the corner braces 116 are unfastened from adjacent panels and pivoted into the second position. In some embodiments, each corner brace 116 may be pivoted against the panel 110*a-d* to which the brace 116 is attached; this may permit the panel 110*a-d* to fold down further into the lower part 101. In some embodiments, a horizontal cross-section of the at least one corner brace 116 is substantially arcuate; in other words, the at least one corner brace 116 may be curved horizontally, for instance so that the at least one corner brace 116 can form rounded corner in a substantially polygonal upper part 109 with filleted corners. All horizontal cross-sections of the at least one corner brace may be substantially arcuate. In some embodiments, the at least one corner brace 116 includes at least one reinforcing rib 119; the at least one reinforcing rib 119 may be constructed of any material or combination of materials used to construct the at least one corner brace 116.

The luggage item 100 includes at least one fastener 117 that attaches each corner brace 116 of the at least one corner brace 116 to the interior surface of a second panel 110*b*, adjacent to the first panel 118, of the plurality of panels 110*a-d*. The fastener may be detachable; that is, a user may be able to detach the fastener 117 rapidly, and reattach the fastener 117 rapidly, without the use of tools, an arbitrarily great number of times without damaging the fastener 117. The fastener 117 may be constructed from any material or combination of materials suitable for constructing the bottom 102. The fastener 117 may include any kind of fastener able to secure the corner brace 116 to the interior surface of the second panel 110*b*. The fastener 117 may include a hook-and-loop fastener such as VELCRO, which is produced by Velcro Industries of Curaçao. The fastener 117 may include a press fastener. The fastener 117 may include a latch. The fastener 117 may include a slide fastener such as a zipper. The fastener 117 may include one or more snaps. The fastener 117 may include any form of buckle. In some embodiments, the fastener 117 includes a slide-release buckle. The slide-release buckle may have a female portion installed on the adjacent panel 110*b* near to the edge 114 of the adjacent panel 110*b* that is most proximal to the corner brace 116, and a male portion attached to the corner brace 116 via an elongated strip that projects away from the corner brace 116 and as far as the most proximal edge 114 of the adjacent panel 110*b*; the male portion may be attached to the distal end of the strip, and oriented so that the male portion is inserted in the female portion in the direction of the corner brace 116, as shown for instance in FIG. 1A. The female portion may, in addition to the form of a tube with a rectangular profile, include a gap in the tube having substantially the same width as the strip, permitting the strip to be inserted in the female portion, so that the male portion may be drawn into engagement with the female portion by the action of moving the first panel 110*a* and adjacent panel 110*b* into the deployed position.

In some embodiments, as shown in FIGS. 1E-1I, the fastener 117 is a latch including a first member 117*a* having a proximal end fixed to the corner brace 116 and a distal end; the distal end may contact the interior surface 111 of the adjacent panel 110*a*; for instance, where the corner brace 116 is pivotally connected to the first panel 110*a*, the first member 117*a* may contact the interior surface 111 when the corner brace 116 is in the extended position. The first member 117*a* may have a hole through the first member. The hole may be adjacent to the distal end of the first member. The fastener 117 may include a peg 117*b* that fits through the hole. The hole and the peg may have any shape conducive to allowing the peg to fit through the hole. The hole may be substantially polygonal; the vertices of the polygon may be angular or filleted with straight or curved fillets. The hole may have one or more curved portions. As a non-limiting example, the hole may be substantially rectangular. The peg 117*b* may have any form that will allow the peg to be inserted through the hole; in some embodiments, the peg 117*b* has a cross-sectional shape substantially identical to the shape of the hole, so that the peg 117*b* fits snugly in the hole. As a non-limiting example, where the hole is substantially rectangular, the peg 117*b* may have a substantially rectangular cross-section. The end of the peg 117*b* may be tapered to a smaller area than the maximal cross-section of the peg 117*b*; the taper may permit the peg 117*b* to be inserted easily into the hole while fitting snugly within the hole.

Figure 1E:
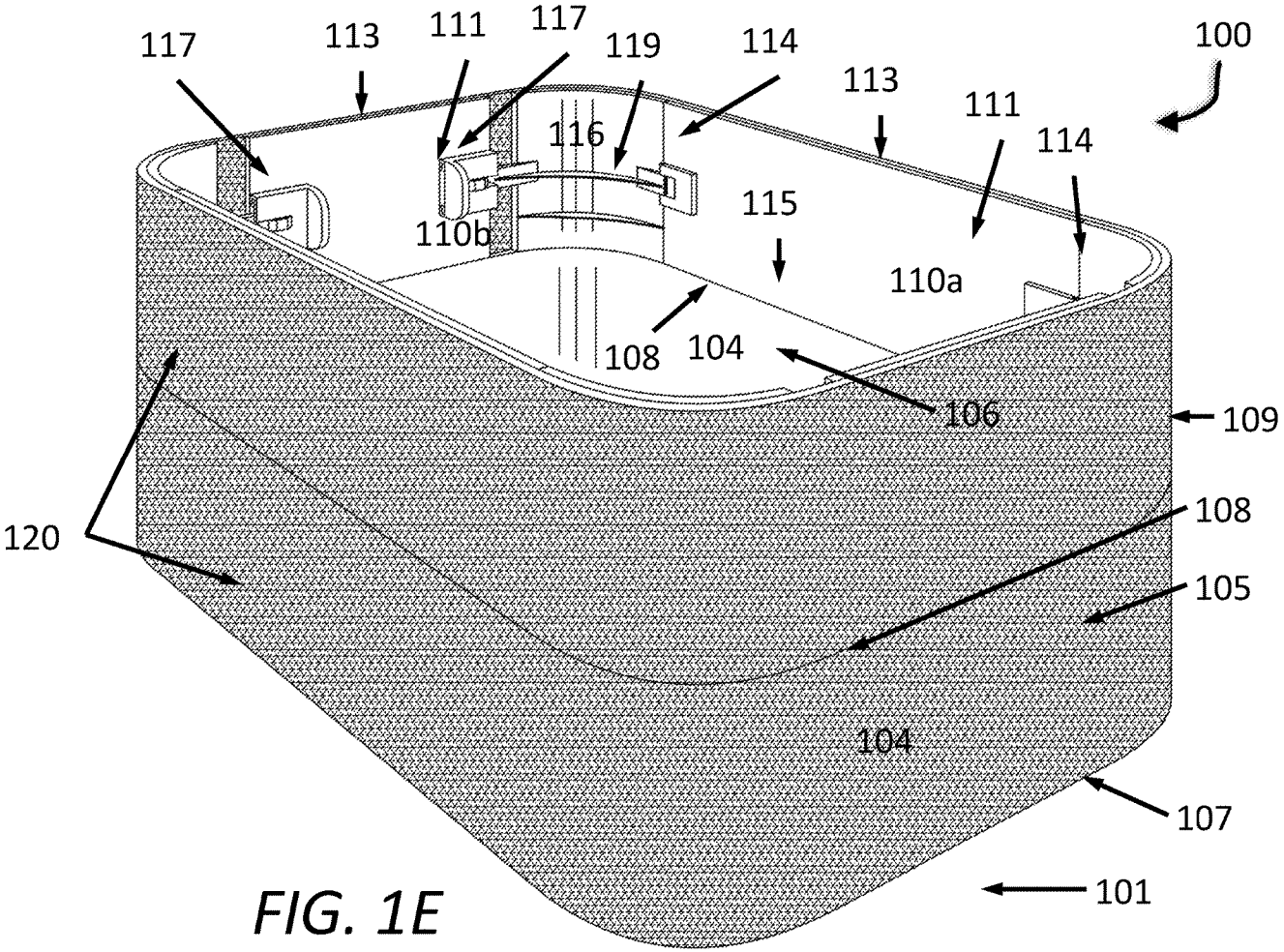
FIG. 1E is a schematic diagram showing an embodiment of the collapsible luggage item.
Figure 1F:
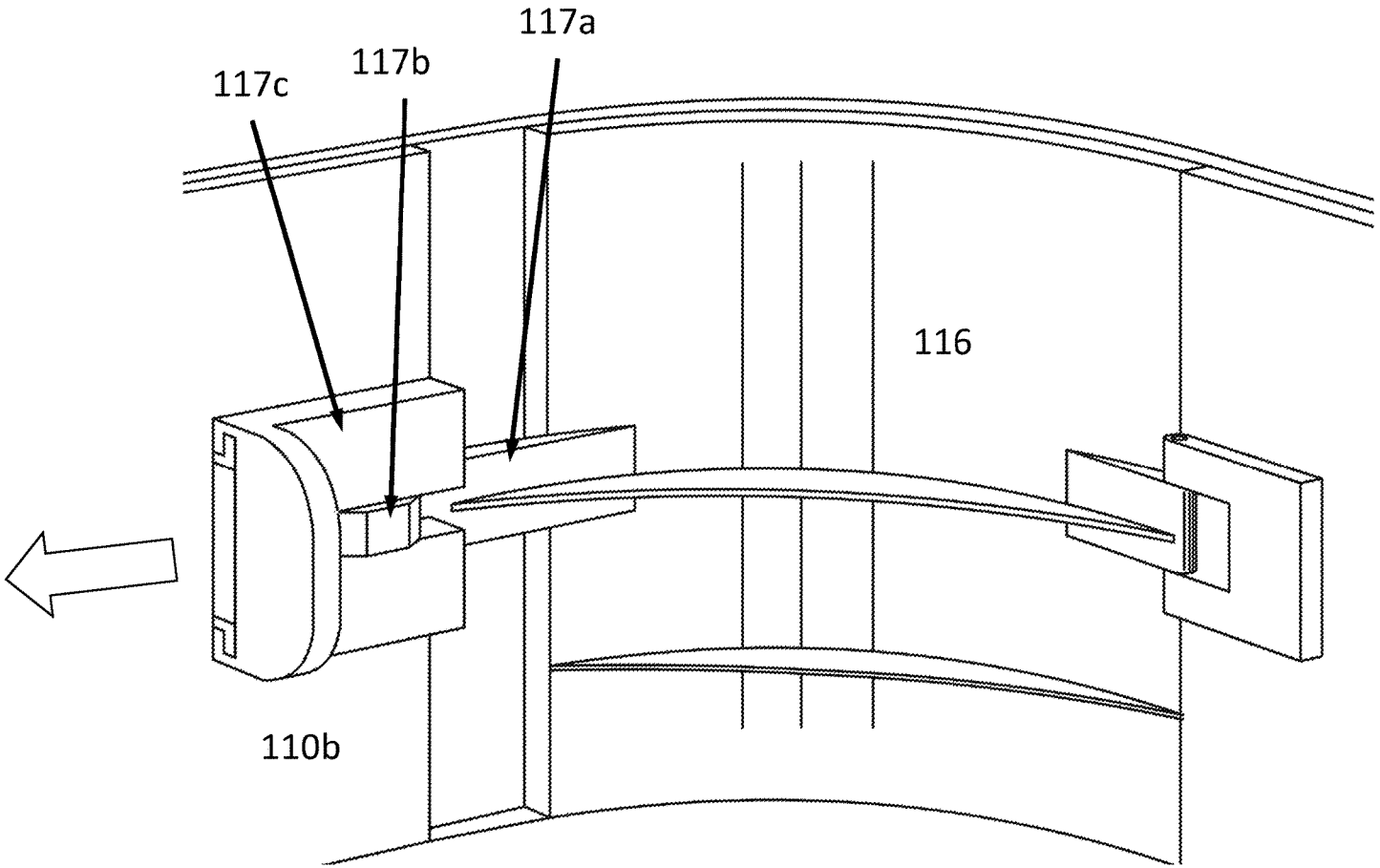
FIG. 1F is a schematic diagram showing a close-up view of an embodiment of a fastener.
Figure 1G:
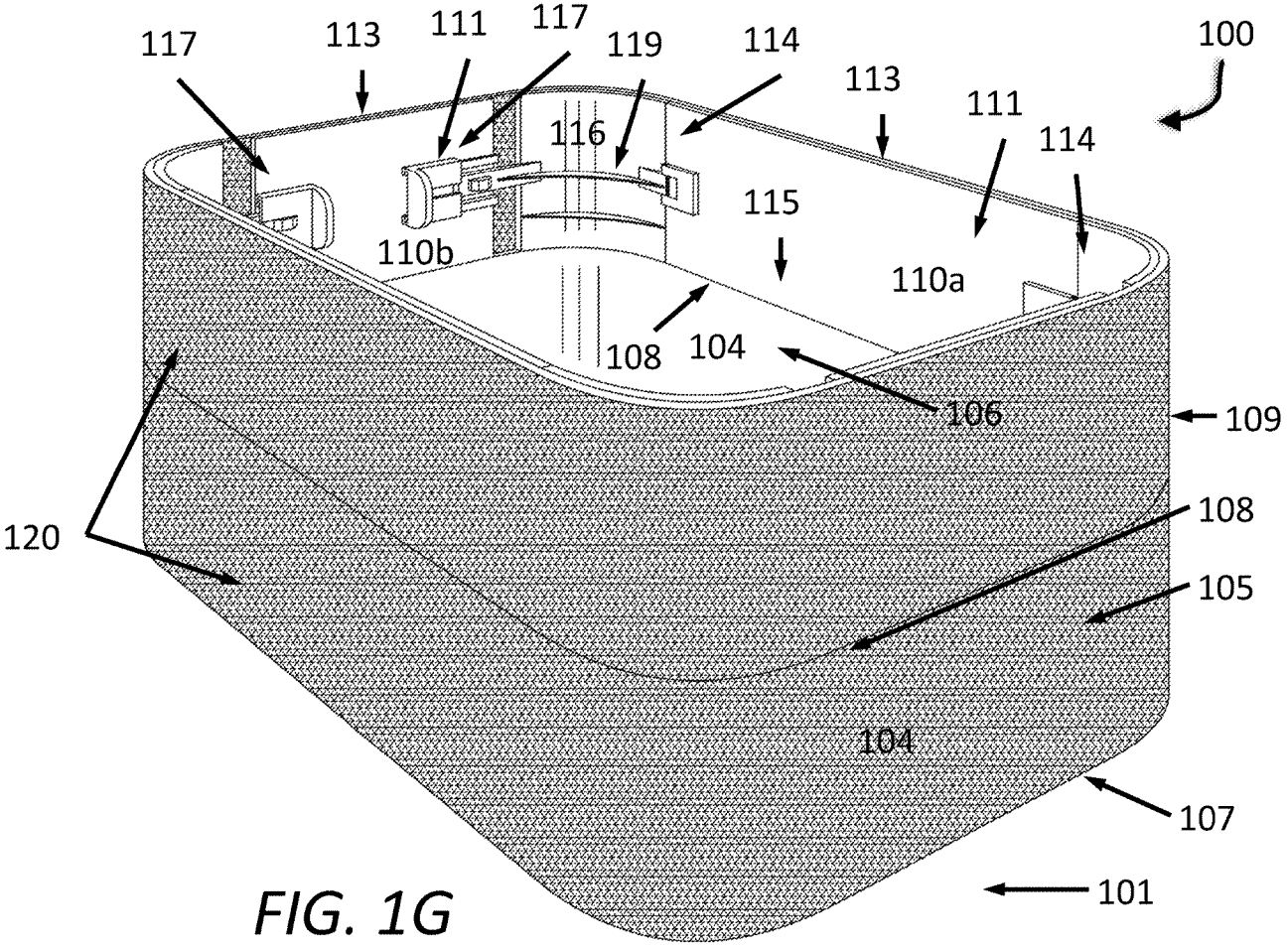
FIG. 1G is a schematic diagram showing an embodiment of the collapsible luggage item.
Figure 1H:
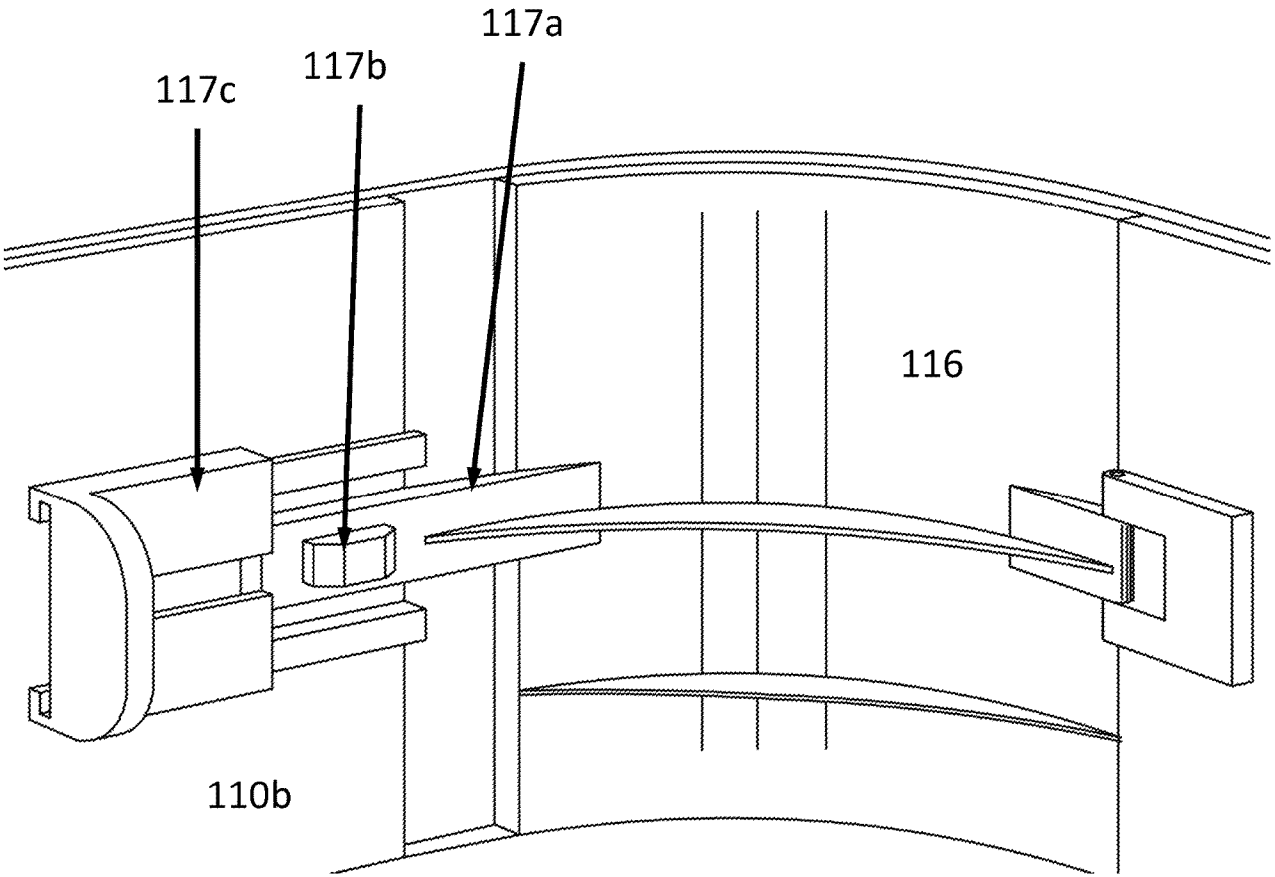
FIG. 1H is a schematic diagram showing a close-up view of an embodiment of a fastener.
Figure 1I:
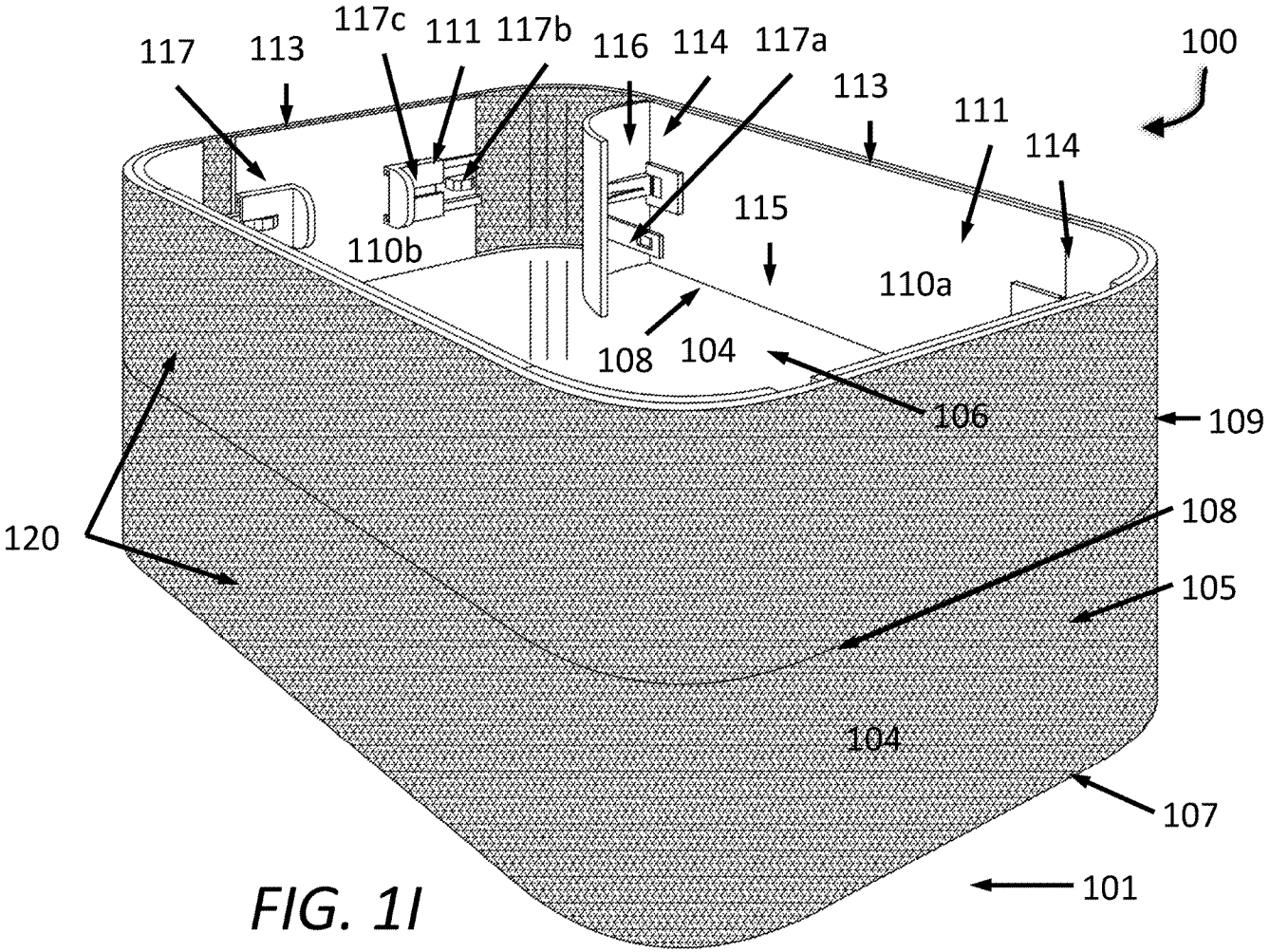
FIG. 1I is a schematic diagram showing an embodiment of the collapsible luggage item with an unfastened corner brace.

The fastener 117 may include a locking member 117*c*. The locking member 117*c* may be slidably engaged to the adjacent panel 110*b*. The slidable engagement may be achieved using any means for securing one object slidably against another, such as interlocking lips or grooves. For instance, the locking member 117*c* may have two lips that extend in a parallel direction to the interior surface 111 of the adjacent panel 110*b*, and the adjacent panel may have two lips fixed to it so that each of the two lips of the locking member 117*c* is slidably held between a lip attached to the adjacent panel 110*b* and the interior surface 111 of the adjacent panel; as a result, the lips of the locking member 117*c*, and thus the locking member 117*c* itself, may be held against the adjacent panel 110*b* with movement restricted to sliding along the lips attached to the adjacent panel. The locking member 117*c* may be substantially flat; in some embodiments, the locking member 117*c* may have a projection such as a handle that a user can grip to slide the locking member 117*c*. The locking member 117*c* may be moveable between a locked position, for instance as illustrated in FIGS. 1E-F in which the first member 117*a* is between the locking member 117*c* and the interior surface 111 of the adjacent panel 110*b* so that the first member 117*a* cannot be removed from the peg 117*b*, and an unlocked position, for example as illustrated in FIGS. 1G-1H in which the first member 117*a* may be removed from the peg 117*b*. FIG. 1I illustrates an exemplary embodiment in which the first member 117*a* has been removed from the peg 117*b*; this detaches the first member 117*a* and corner brace 116 from the adjacent panel 110*b*. When the first member 117*a* is on the peg 117*b* and the locking member 117*c* is in the locked position, the corner brace 116 may be fastened by the fastener 117 to the adjacent panel 110*b*, keeping the first panel 110*a* and adjacent panel 110*b* in their deployed positions.

Figure 4:
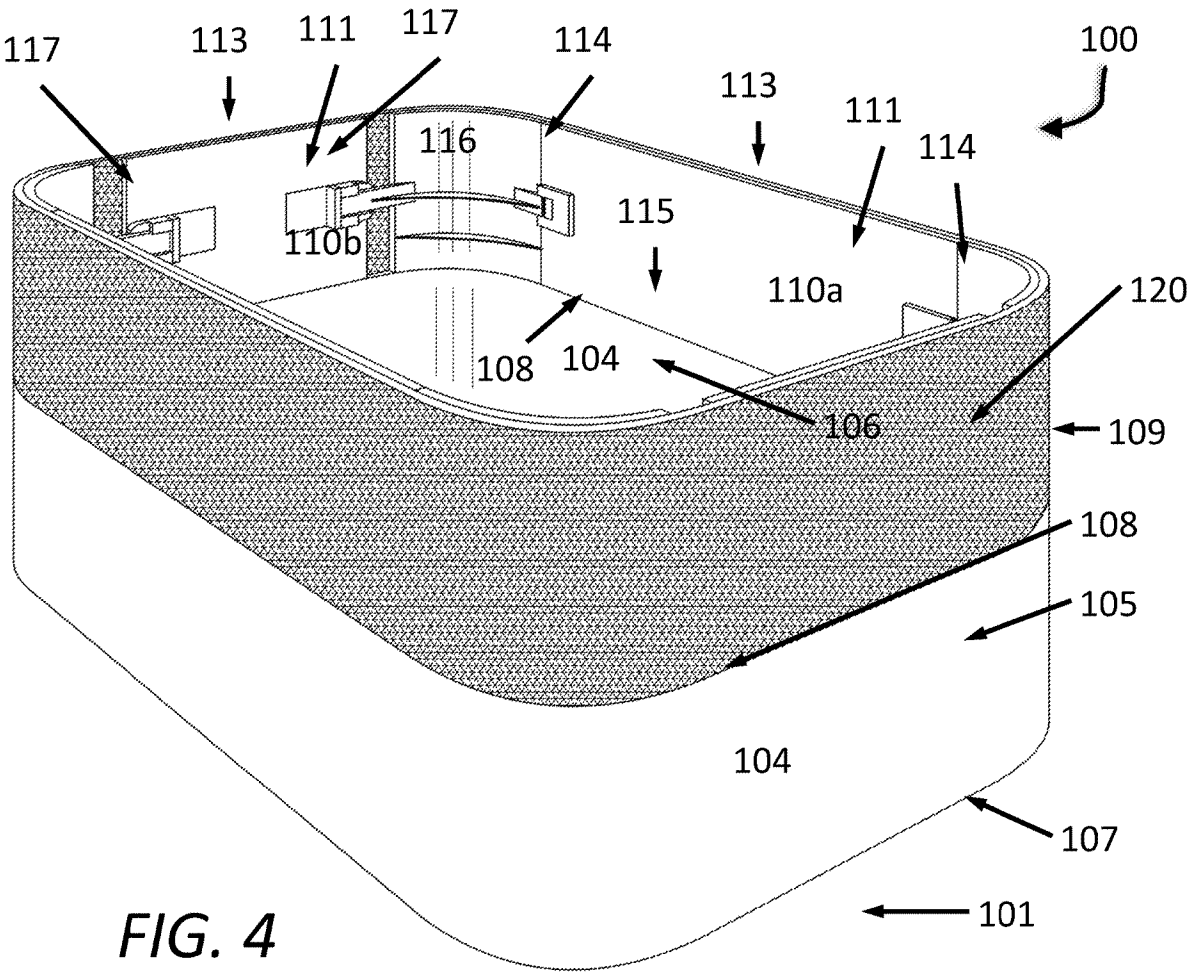
FIG. 4 is a schematic diagram showing one embodiment of a variation in an exterior cover.

The luggage item 100 may include an exterior cover 120. In some embodiments, the exterior cover 120 includes a flexible exterior cover that contacts the exterior surfaces of the plurality of panels 110*a-d* when in deployed position. The exterior cover 120 may be constructed of any flexible material or combination of materials, including without limitation textiles, flexible polymer sheets such as rubber, silicone, or flexible plastic, or fiber mats. The exterior cover 120 may be attached to the exterior surfaces of the plurality of panels. Without limitation, the attachment may be effected by adhesion, fastening with screws, bolts, rivets, staples, or similar fasteners, by sewing the panels 110*a-d* to the exterior cover 120, or by inserting the panels 110*a-c* in one or more pockets or sleeves formed by one or more portions of the exterior cover 120. In some embodiments, the exterior cover 120 spans the gaps between adjacent panels; the at least one corner brace 116 may contact the exterior cover 120 where the exterior cover 120 bridges the gaps, when the fastener 119 is fastened. For instance, the upper part 109, when fully deployed, may form a rectangular box with rounded corners, and appear to be a substantially rigid structure covered by the exterior cover 120; the rigid structure beneath the exterior cover 120 at the rounded corners may be formed by the corner braces 116, while the rigid structure within the sides of the box may be formed by the plurality of panels 110*a-d*. The exterior cover 120 may cover only the exterior of the upper part; for instance, in some embodiments, the exterior cover 120 has a lower edge attached to the upper edge of the sidewall, as shown in FIG. 4. The lower part 101 may have an exterior surface constructed of any material or combination of materials suitable for forming the bottom 102; the exterior surface of the lower part 101 may be formed to be flush with the exterior surface. In other embodiments, the exterior cover 120 covers at least the sidewall 104 and the upper part 109; the exterior cover may have a lower edge attached to the bottom 102. In some embodiments, the exterior cover covers substantially all of the of the bottom 102 and the exterior surface of the sidewall 104. The plurality of panels 110*a-d* may be pivotally attached to lower portion 101 by the exterior cover 120.

Figure 5:
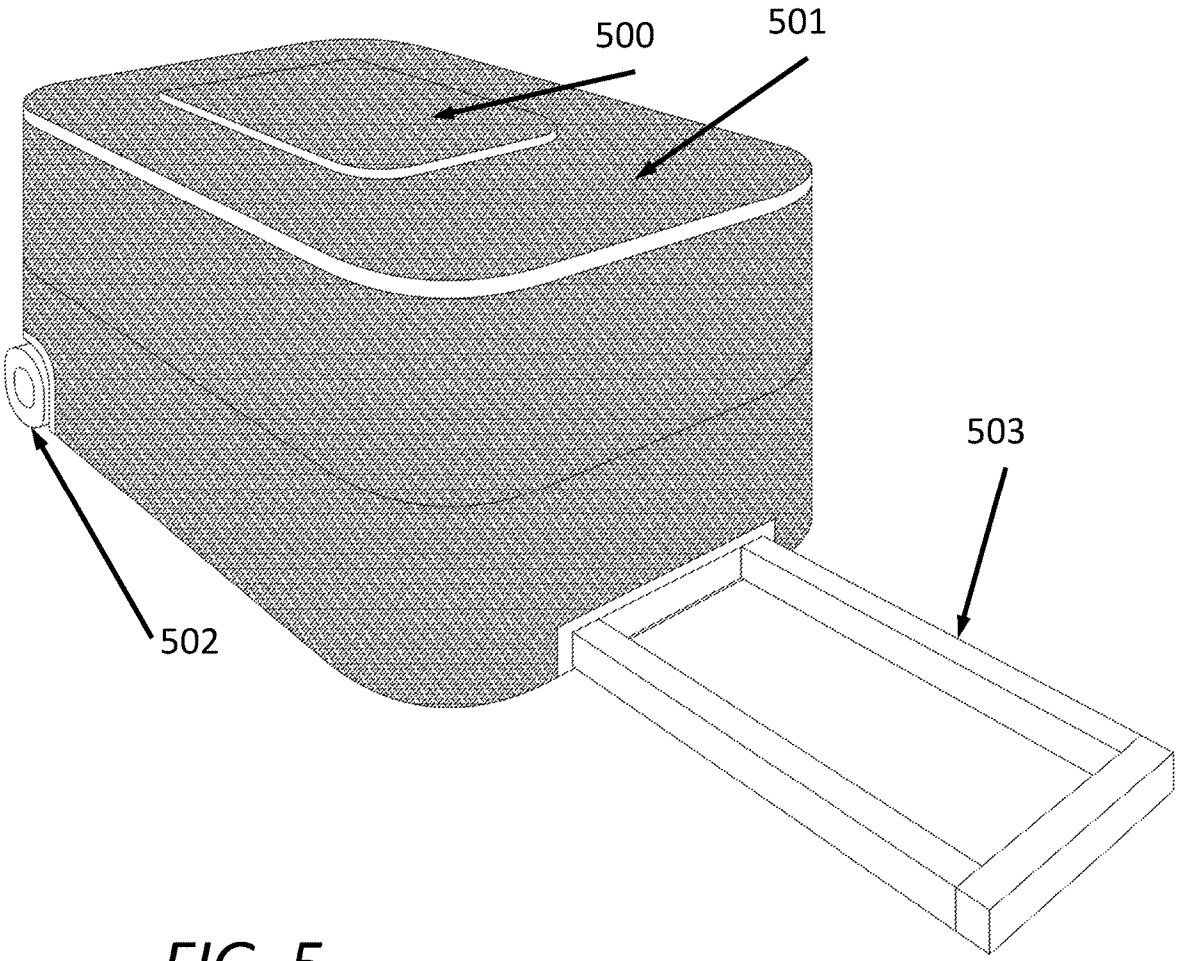
FIG. 5 is a schematic diagram showing an embodiment of a luggage item.

The luggage item 100 may have any form consistent with a substantially rigid luggage item. Without limitation, the luggage item 100 may have the form of a suitcase, a large or small rigid luggage item, such as those commonly used in air travel, a "carry-on bag," a backpack, an attaché case, or a briefcase. The luggage item 100 may have any additional feature associated with luggage items. For instance, as shown in FIG. 5, the exterior cover 120 may include at least one pocket 500 accessible from an exterior surface of the exterior cover 120. The luggage item 100 may also include one or more pockets (not shown) in its interior. The luggage item 100 may include a lid 501 moveable to cover the opening of the item of luggage; the lid may be attached to the opening by any means usable to fix a lid in a closed position, including using a zipper, a hook-and-loop fastener, one or more snaps or buckles, one or more straps, or one or more button and button-hole combinations. The luggage item 100 may be an item of wheeled luggage; that is, the luggage item 100 may include at least one wheel 502 attached to the luggage item 100, so that the at least one wheel 502 contacts a walking surface when a user drags the luggage item 100 across the walking surface. The luggage item 100 may include an extension handle 503 that a user may grip to drag the luggage item 100 across a walking surface. The extension handle may fold or retract; for instance, the extension handle 503 may retract into a chamber in the bottom 102 of the luggage item 100 when not in use.

Figure 6:
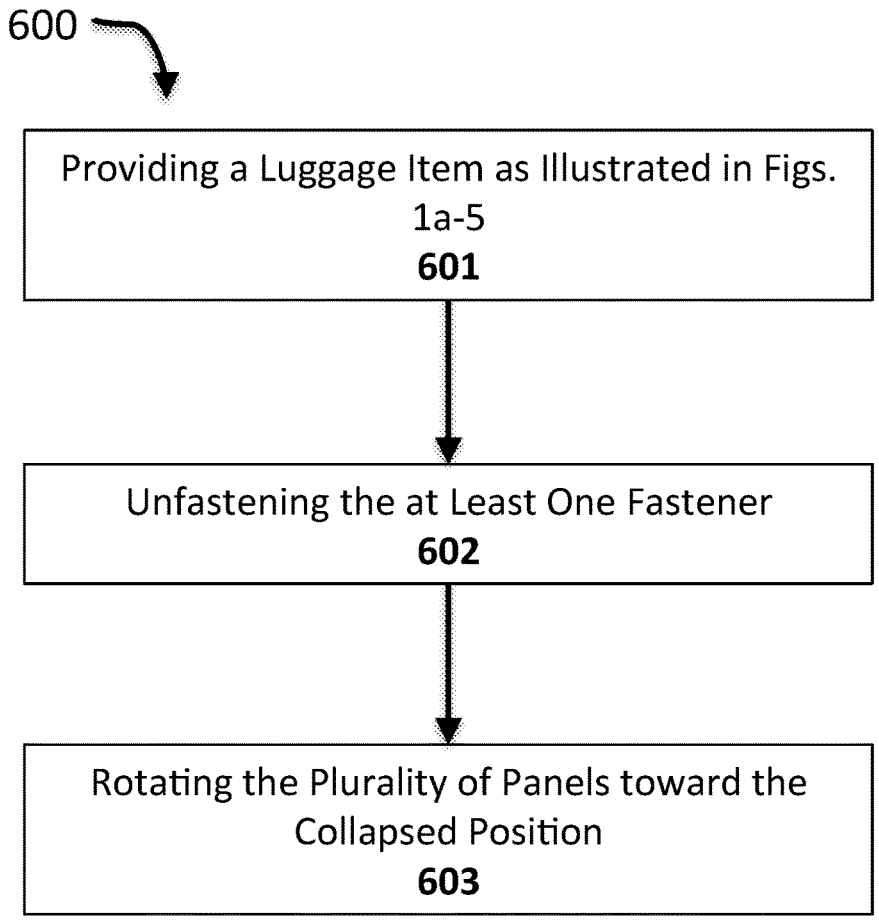
FIG. 6 is a flow diagram illustrating one embodiment of the disclosed method for collapsing a collapsible luggage item.

FIG. 6 is a flow chart illustrating one embodiment of the disclosed method 600 for collapsing an item of luggage. The method 600 includes providing a luggage item as described above in reference to FIGS. 1A-5 (601). The method 600 includes unfastening the at least one fastener (602). The method 600 includes rotating the plurality of panels toward the collapsed position.

Reviewing FIG. 6 in further detail, and by reference to FIGS. 1A-5, the method 600 includes providing a luggage item as described above in reference to FIGS. 1A-5 (601). The luggage item 100 may be fully deployed, with all panels in the deployed position, and all fasteners fastened, as described above in reference to FIGS. 1A-5. In some embodiments, the lid 501 of the luggage item is closed, and the user opens the lid 501 prior to proceeding with additional steps.

The method 600 includes unfastening the at least one fastener (602). In some embodiments, the user unfastens the fastener by moving the corner brace 116 or first panel 110*a* relative to the adjacent panel 110*b*. For instance, where the fastener 117 is a slide release buckle that has a male portion attached to and oriented toward the corner brace, the user may pull the corner brace 116 toward the adjacent panel 110*b* to remove the male portion from the female portion. In some embodiments, where the at least one corner brace 116 is pivotally attached to the first panel 110*a*, the user may pivot the at least one corner brace 116 away from the adjacent panel 110*b*.

The method 600 includes rotating the plurality of panels toward the collapsed position (603). In some embodiments, the user rotates each of the panels 110*a-d* in turn toward the collapsed position. In other embodiments, the user rotates all of the panels 110*a-d* in a single motion, causing them to overlap as the upper part 109 collapses. FIGS. 2C and 2D illustrate an embodiment of this approach to collapsing the upper part 109 of the luggage item 101.

In some embodiments, the user deploys the luggage item 100 by substantially reversing the steps of the method 600: the user may rotate each of the panels 100*a-d* into the deployed position and fasten each of the fasteners 117. In some embodiments, the user also rotates the corner braces 116 into their first position. The rotation of panels 110*a-d* and engagement of the fasteners 117 may be performed in substantially the same movement, particularly where the fasteners 117 are designed to fasten by substantially the same action as that required to rotate the panels 110*a-d* into deployed position; for example, where the fastener is a slide release buckle that has a male portion attached to and oriented toward the corner brace 116, the rotation of a panel bearing the corner brace 116*b* may cause the male portion of the fastener 117 to slide into the female portion of the fastener 117, particularly if the user guides the fastener 117 to attach while deploying the first panel 110*a* and adjacent panel 110*b*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A collapsible luggage, comprising:

a lower part forming an open-topped box comprising a substantially rigid bottom, the bottom having an interior surface, and a substantially rigid sidewall substantially perpendicular to the bottom, the sidewall having an exterior surface, an interior surface, a lower edge attached to the bottom, and an upper edge defining a perimeter of an opening of the lower part, the interior surface of the bottom and the interior surface of the sidewall defining an interior of the lower part; and a collapsible upper part comprising:

a plurality of panels, each panel of the plurality of panels having an interior surface, an exterior surface, a top edge, and a bottom edge pivotally joined to the upper edge of the sidewall so that each panel may be rotated between a deployed position substantially parallel to the sidewall with the top edge of the panel above the bottom edge of the panel and a collapsed position with the panel folded into the interior of the lower part, the top edges of the plurality of panels combining to define an opening of the luggage item when each of the plurality of panels is in the deployed position;

at least one substantially rigid corner brace attached to a first panel of the plurality of panels; and at least one fastener that attaches each corner brace of the at least one corner brace to the interior surface of a second panel, adjacent to the first panel, of the plurality of panels; wherein the collapsible upper part is collapsed into the lower part selectively.

2. The luggage of claim 1, wherein the plurality of panels comprises four panels.

3. The luggage of claim 2, wherein the at least one corner brace comprises four corner braces.

4. The luggage of claim 3, wherein two of the corner braces are attached to the first panel and two more of the corner braces are attached to a third panel, of the plurality of panels, which is not adjacent to the first panel.

5. The luggage of claim 3, wherein one corner brace is attached to each of the four panels.

6. The luggage of claim 1, wherein the at least one corner brace is pivotally connected to the interior surface of the first panel, the at least one corner brace movable between an extended position sufficiently close to the interior surface of the adjacent panel to fasten the fastener when the plurality of panels are in the deployed position and a folded position too distant from the interior surface of the adjacent panel to fasten the fastener when the plurality of panels are in the deployed position.

7. The luggage of claim 1, wherein a horizontal cross-section of the at least one corner brace is substantially arcuate.

8. The luggage of claim 1, wherein the at least one corner brace includes at least one reinforcing rib.

9. The luggage of claim 1, wherein the at least one fastener further comprises:

a first member comprising a proximal end fixed to the corner brace and a distal end, the first member having a hole through the first member at the distal end;

a peg fixed to the adjacent panel, the peg inserted through the hole when the first member is against the interior surface of the adjacent panel; and a locking member slidably engaged to the adjacent panel, the locking member movable between a locked position in which the first member is between the locking member and the interior surface of the adjacent panel so that the first member cannot be removed from the peg, and an unlocked position in which the first member may be removed from the peg.

10. The luggage of claim 1 further comprising a flexible exterior cover that contacts the exterior surfaces of the plurality of panels when in deployed position.

11. The luggage of claim 10, wherein the exterior cover is attached to the exterior surfaces of the plurality of panels.

12. The luggage of claim 10, wherein the exterior cover has a lower edge attached to the upper edge of the sidewall.

13. The luggage of claim 10, wherein the exterior cover has a lower edge attached to the bottom surface.

14. The luggage of claim 10, wherein the exterior cover covers substantially all of the bottom and the exterior surface of the sidewall.

15. The luggage of claim 10, wherein the plurality of panels is pivotally attached to lower portion by the exterior cover.

16. The luggage of claim 10, wherein the exterior cover comprises at least one pocket accessible from an exterior surface of the exterior cover.

17. The luggage of claim 1 further comprising a lid moveable to cover the opening of the item of luggage.

18. The luggage of claim 1 further comprising at least one wheel attached to the luggage, so that the at least one wheel contacts a walking surface when a user drags the luggage across the walking surface.

19. The luggage of claim 1 further comprising an extension handle that a user may grip to drag the luggage across a walking surface.

20. A method for collapsing a collapsible luggage, the method comprising:

providing a luggage according to claim 1;

unfastening the at least one fastener; and rotating the plurality of panels toward the collapsed position.

* * * * *